US007559859B2

(12) United States Patent
Rodgers, Jr. et al.

(10) Patent No.: US 7,559,859 B2
(45) Date of Patent: Jul. 14, 2009

(54) TENNIS TRAINING AID

(75) Inventors: James Bowmar Rodgers, Jr., Atherton, CA (US); Raymond Neil Bilsey, Belmont, CA (US); Maurice Aurthur LeBlanc, Jr., Redwood City, CA (US)

(73) Assignee: SquareHit Sports, Inc., Palo Alto, CA (US)

( * ) Notice: Subject to any disclaimer, the term of this patent is extended or adjusted under 35 U.S.C. 154(b) by 0 days.

(21) Appl. No.: 11/938,074

(22) Filed: Nov. 9, 2007

(65) Prior Publication Data

US 2008/0220911 A1 Sep. 11, 2008

Related U.S. Application Data

(63) Continuation-in-part of application No. 11/580,971, filed on Oct. 13, 2006, now Pat. No. 7,445,570.

(60) Provisional application No. 60/727,413, filed on Oct. 17, 2005.

(51) Int. Cl.
*A63B 69/38* (2006.01)

(52) U.S. Cl. ..... 473/464; 473/461

(58) Field of Classification Search ..... 473/459, 473/461, 464, 212, 213; 273/DIG. 21
See application file for complete search history.

(56) References Cited

U.S. PATENT DOCUMENTS

| | | | | |
|---|---|---|---|---|
| 5,005,833 | A * | 4/1991 | Groveman et al. | 473/464 |
| 5,618,040 | A * | 4/1997 | Parten | 473/461 |
| 6,863,616 | B2 * | 3/2005 | Snyder et al. | 473/212 |
| 7,147,581 | B1 * | 12/2006 | Williams, III | 473/464 |
| 2006/0287139 | A1 * | 12/2006 | Williams, III | 473/464 |
| 2007/0078032 | A1 * | 4/2007 | Kunsman | 473/464 |
| 2007/0087868 | A1 * | 4/2007 | Williams, III | 473/464 |
| 2007/0123372 | A1 * | 5/2007 | Bilsey et al. | 473/464 |
| 2007/0191146 | A1 * | 8/2007 | Darmohusodo et al. | 473/464 |
| 2007/0275796 | A1 * | 11/2007 | Carter | 473/459 |

* cited by examiner

*Primary Examiner*—Raleigh W. Chiu
(74) *Attorney, Agent, or Firm*—DLA Piper LLP (US)

(57) ABSTRACT

A tennis training aid can be used to teach proper wrist and racket position for swings such as a forehand ground stroke, two-handed backhand stroke, or volley. Such a tennis training aid is provided herein and includes a forearm attachment member operable to be releasably attached to a forearm of a player. The tennis training aid also includes a tether attachment having a first and second end, such that the first end is attached to the forearm attachment member and the second end is attached to a tennis racket throat in order to hold the wrist of the forearm holding that racket at a desired angle so as to allow the player to practice a plurality of different tennis strokes.

23 Claims, 24 Drawing Sheets

TENNIS TRAINING AID

This application is a Continuation-in-Part of U.S. patent application Ser. No. 11/580,971, filed Oct. 13, 2006 now U.S. Pat. No. 7,445,570, which claims the benefit of U.S. Provisional Patent Application No. 60/727,413 filed Oct. 17, 2005, and entitled Tennis Training Aid.

TECHNICAL FIELD OF THE INVENTION

The present invention relates to methods and devices useful for training, such as for training proper form when using a piece of athletic equipment.

BACKGROUND

There are several flaws that are common among tennis players, particularly those players just learning the game. Many of these flaws occur in the swing or stroke of a player, due in part to that player having improper positioning and/or movement of the wrist and/or racket. This can occur during a forehand ground stroke, a two-handed backhand stroke, one-handed backhand stroke, or a volley, for example.

For a forehand ground stroke, the recommended wrist position has the wrist cocked or laid-back throughout the impact/contact position and throughout the forehand stroke. Many recreational players incorrectly snap their wrist forward, this forward movement of the wrist and corresponding decrease in angle being called "flexion." The palm of the hand typically is moved toward the front of the forearm (palmar surface of the forearm), resulting in an undesired movement in the forehand ground stroke that often is difficult for players to eliminate. Too much movement of the wrist at impact, or an improper wrist angle at impact, can adversely affect the control, power, and accuracy of a player, and eventually can affect that player's success and enjoyment of the game.

A similar problem exists for a two-handed backhand ground stroke, particularly for the non-dominant hand. A flexion of the non-dominant hand can occur, as well as an improper setting of the wrist angle of that non-dominant hand. These flaws can again impact the control, power, and accuracy of a player.

Other common flaws occur during volley. A volley is defined as a shot that is hit prior to the ball bouncing, and typically is hit close to the net. Usually a much shorter stroke should be employed, and the ball is hit with the racket titled upwards. Many players incorrectly drop their racket head during the volley stroke and employ too much wrist movement during the stroke. Good volley technique usually implies that the player keeps the racket tilted diagonally upwards, with the racket tip pointing away from the player (and slightly upward). It is common that players use too much wrist movement during the stroke. Many players also incorrectly drop their racket by moving their wrist downward during the volley stroke.

A number of different training aids have been presented in the prior art to attempt to correct for some of these problems. There are a number of deficiencies with these devices, however, which have prevented their widespread acceptance and use. For example, many of these devices are uncomfortable to wear and can feel unnatural to use. Some of these devices are unnecessarily complicated. Some of these devices do not provide enough guidance as to the proper technique to train or drill with. Another problem is that a user or trainer must purchase several of these training aids to attempt to address these flaws. Some lack the ability to control or guide the hand or wrist while playing, thereby limiting their effectiveness.

It would therefore be desirable to provide a tennis training aid that is operable in multiple usage modes to allow a player to easily, effectively and comfortably practice different types of tennis strokes.

SUMMARY OF THE INVENTION

In an embodiment of the present invention, a tennis training aid is provided. The tennis training aid includes a forearm attachment member operable to be releasably attached to a forearm of a player. The tennis training aid also includes a tether attachment having a first and second end, such that the first end is attached to the forearm attachment member and the second end is attached to a tennis racket throat in order to hold the wrist of the forearm holding that racket at a desired angle so as to allow the player to practice a plurality of different tennis strokes.

These and other features, advantages and embodiments will be appreciated by a review of the following detailed description and related drawings.

DETAILED DESCRIPTION OF THE EMBODIMENTS

Figure 1:
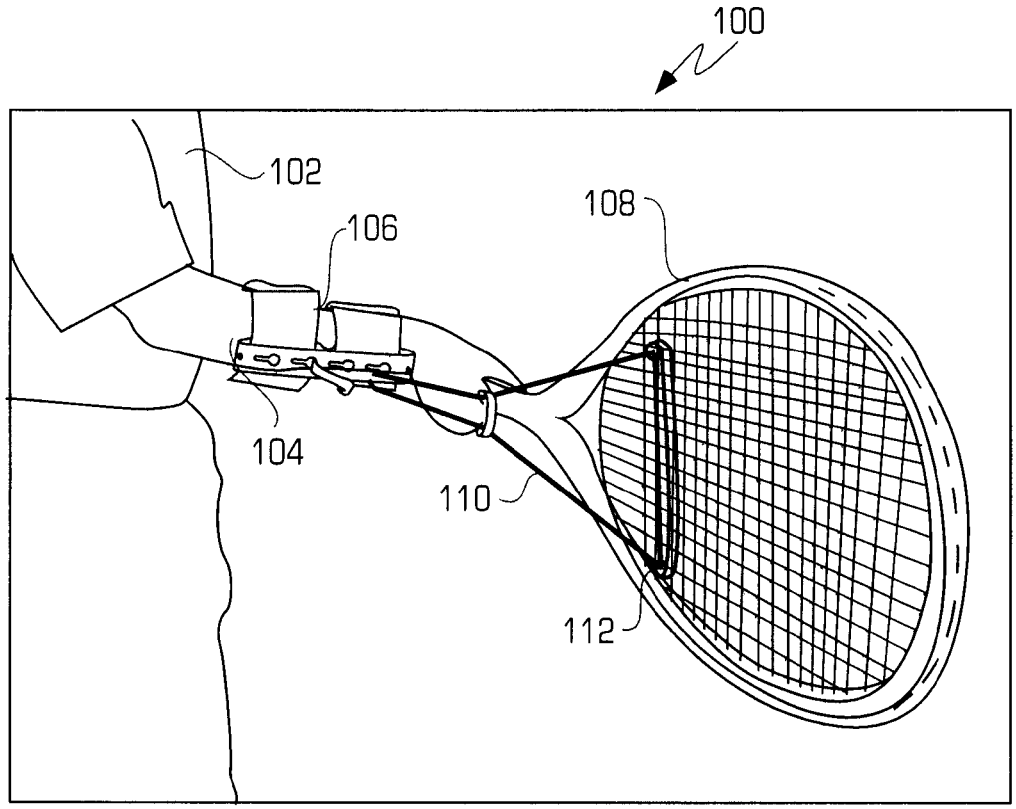
FIG. 1 is a view of a tennis training aid that can be used in accordance with one embodiment of the present invention.

The present invention will now be described in detail with reference to the drawings, which are provided as illustrative examples of the invention so as to enable those skilled in the art to practice the invention. Notably, the figures and examples below are not meant to limit the scope of the present invention. Moreover, where certain elements of the present invention can be partially or fully implemented using known components, only those portions of such known components that are necessary for an understanding of the present invention will be described, and detailed descriptions of other portions of such known components will be omitted so as not to obscure the invention. Preferred embodiments of the present invention are illustrated in the Figures, like numerals being used to refer to like and corresponding parts of various drawings.

Systems and methods in accordance with various embodiments of the present invention can overcome these and other deficiencies in prior art training devices. A single training aid can be used to help players feel the correct wrist position throughout various swings, and can reduce the likelihood of improper movements of the wrist during the stroke. Such a device can be used to ensure a proper wrist position, such that a player's racket faces the ball squarely at impact, and that the player contacts the ball just in front of the player's body. Maintaining a proper and stable wrist angle position throughout the swing, and especially through the impact/contact area, can be vital to ensure solid ball contact, the ability to consistently hit the ball at an intended target, sufficient racket stability/power (as racket stability at impact greatly increases power), control/accuracy, and the proper "feeling" when hitting the ball. Another benefit derived from using the training aids of the present invention correctly on both forehand and backhand tennis strokes is that they enable the tennis racket to desirably impart topspin to the tennis ball, thereby better controlling the direction and accuracy of the flight of the ball.

One area discussed above that can be addressed is the forehand ground stroke. In order to properly train a player, it can be desired to set the player in the proper "extension" of the wrist and fix the wrist in this position. A laid-back wrist is referred to as "extension" of the wrist. Extension increases the amount of angle from moving the back of the hand toward the dorsal surface of the forearm. A proper initial angle of the wrist during the forehand ground stroke is typically about 40-75 degrees of "extension."

It also can be desirable to reduce or eliminate flexion of the wrist during the stroke. It can be desirable to reduce or eliminate the user's ability to "flex" the wrist as the user attempts to help/hit the ball during the hitting zone. For example, it can be desirable to set the player into a "fixed" position, such as a position with about 40 to 75 degrees of extension of the wrist depending on the desired wrist angle of the user, and help the player control "flexing" the wrist forward during the entire stroke. For instance, if the player's wrist is initially set at around 60 degrees of extension, and the player moves the wrist significantly forward to 20 degrees of extension (an undesired movement), it would be desirable for the player to feel a device helping the player control the wrist from any undesired movements toward flexion. Eliminating excessive wrist movements and setting the player into a proper wrist angle can help in numerous areas including, improved racket stability, ball control, solid ball contact, racket facing the ball longer during impact, control, overall improved technique, and most importantly help the player "feel" what its like to hit a very solid shot.

Figure 4:
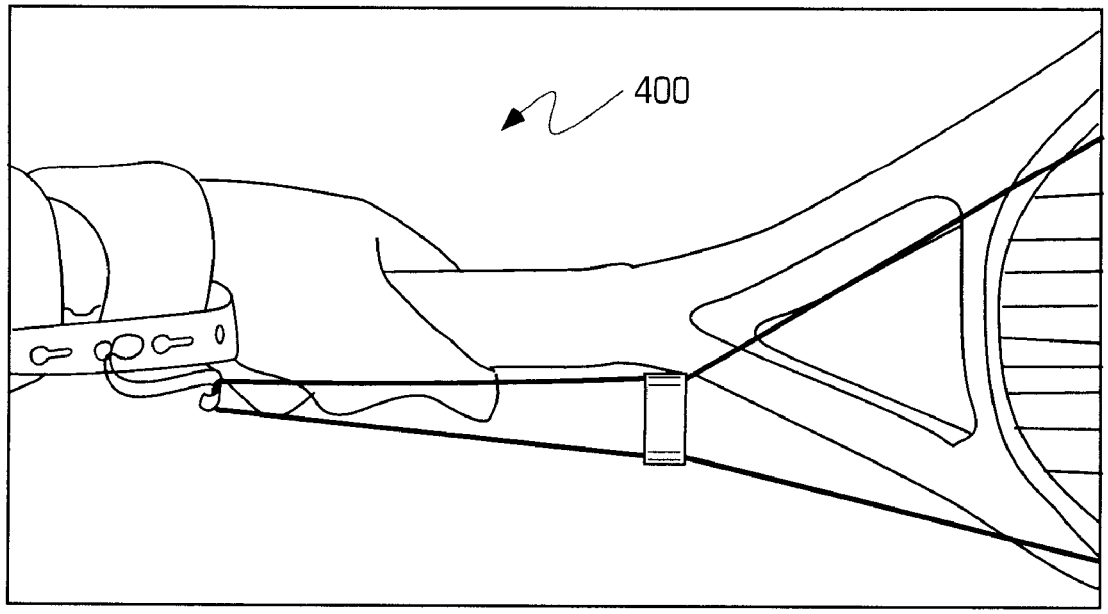
FIG. 4 is another view of the tennis training aid of FIG. 1.

A tennis training aid 100 in accordance with one embodiment is shown in FIGS. 1 and 4. The device includes a forearm attachment member 106 designed to be attached to the forearm 104 of a player 102. This device also includes a wrist positioning member 110 operable to be connected between the forearm attachment member 106 and the player's racket 108 when the player is holding the racket in the respective hand. The device also can include a racket connector 112 shaped to be placed between the strings of the racket 108 in order to provide a connection point(s) for the wrist positioning member 110. It can be seen that when the wrist positioning member 110 is properly connected between the forearm attachment member 106 and the racket 108, the player's wrist is maintained at a position held back toward the forearm, which is the correct position for a forehand ground stroke.

Figure 2:
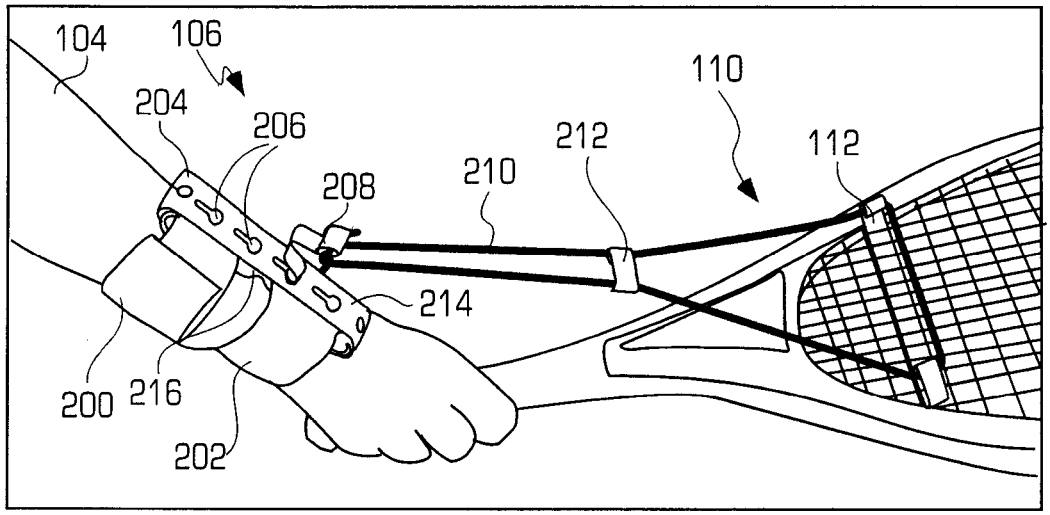
FIG. 2 is another view of the tennis training aid of FIG. 1.

This exemplary training aid is shown in more detail in FIG. 2. Reference numbers are carried over where appropriate for simplicity. Here it can be seen that the forearm attachment member 106 includes first and second forearm straps 200, 202. As shown, these straps can take the form of vinyl straps having Velcro attachment regions allowing the straps to be easily and quickly fastened about the forearm 104 of the player. These straps can be desirable due to their ease of connection and release, their ability to hold the forearm attachment member firmly in place during the stroke, and their ability to allow the underlying skin to breathe. It should be understood that these straps are merely exemplary, and that a number of other fastening mechanisms could be used. For example, a single fastening member can be used to attach the forearm attachment member to the arm of the player. Alternatively, more than two straps can be used. The straps can be formed of any appropriate material, such as leather, rubber, cloth, plastic, or any other flexible or formable material capable of holding the forearm attachment member in place. The fastening mechanism also can be other any appropriate mechanism, such as may include snaps, buttons, ties, clamps, zippers, or clasps. The forearm attachment member also can take the form of a glove or sleeve.

Figure 5:
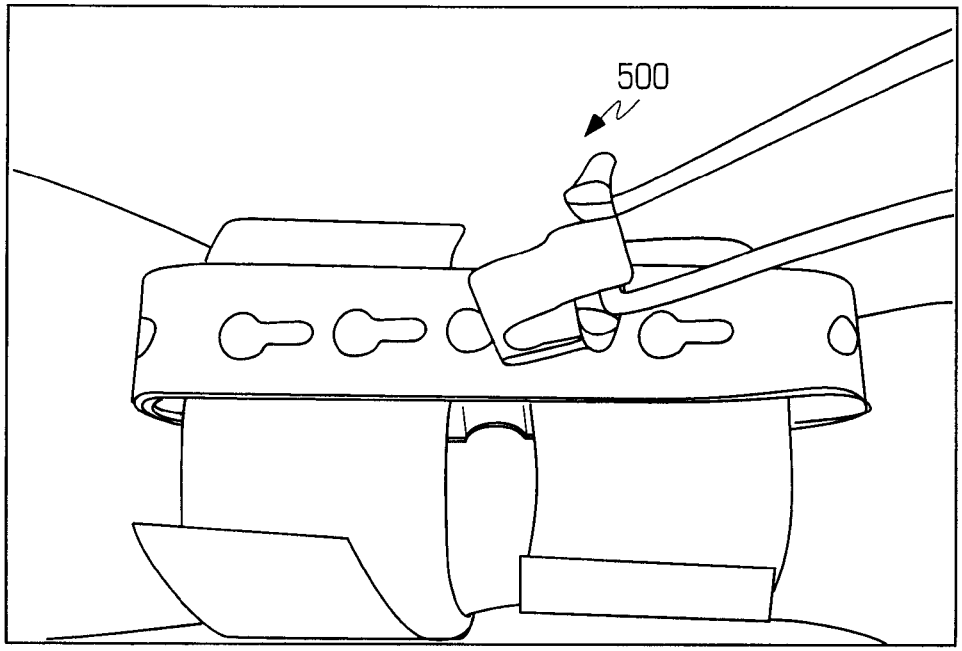
FIG. 5 is another view of the tennis training aid of FIG. 1.

The wrist positioning member 106 also can include a forearm body 204. The forearm body here is shown as an elongated, rigid member (such as a metal or plastic bar) capable of being attached to the forearm via the forearm straps 200, 202. Any of a number of other materials and designs can be used, such as aluminum or leather members of any appropriate shape. The forearm body 204 can include at least one positioning slot 206, but for many embodiments can include a plurality of positioning slots or an adjustable positioning slot. The positioning slot(s) 206 can be used to receive an end of the wrist positioning member 110. Having more than one slot, or an adjustable slot, allows the position of the wrist positioning member 110 to be adjusted relative to the forearm attachment member 106, which can allow for fitting of the training aid based on the size, racket, and comfort of the player. Another view 500 of the forearm attachment member 106 is shown in FIG. 5. The forearm body 204 can include padding, such as foam or another padding material, positioned adjacent the arm of the player in order to improve the overall comfort level for the player.

Figure 6:
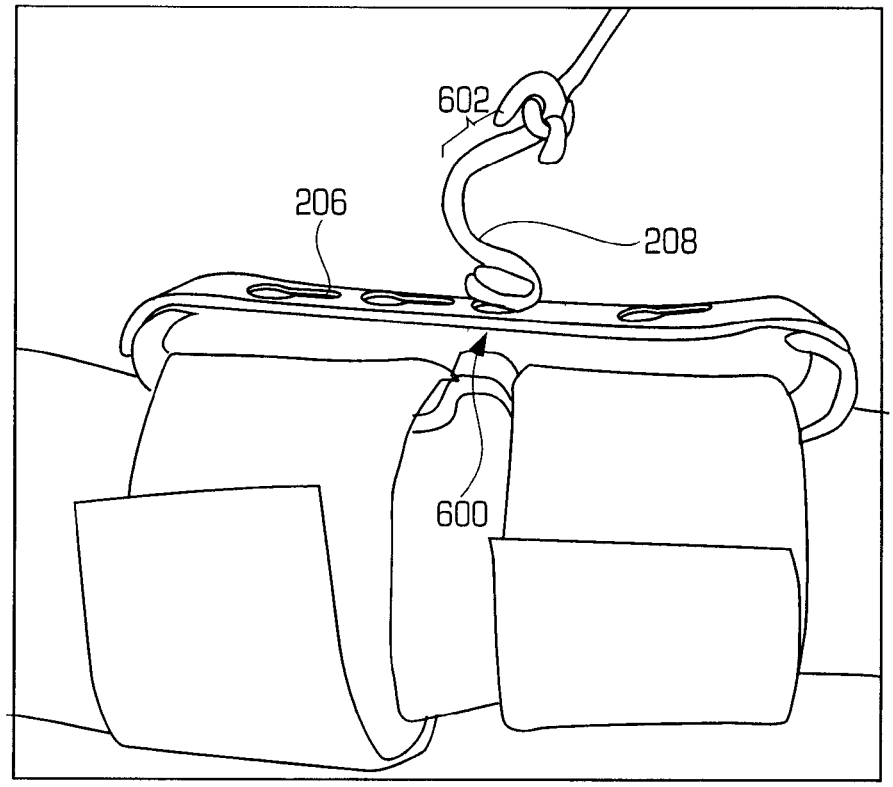
FIG. 6 is another view of the tennis training aid of FIG. 1.

The forearm body 204 in this embodiment is shown in FIG. 6 to extend around the forearm straps to form a sort of oval shape. This provides a number of advantages. First, the shape provides a spacing between the connection slots 206 and the forearm 104, which allows a forearm connector 208 of the wrist positioning member to be placed into one of the slots without contacting the forearm. Without providing such a space, the forearm connector might apply pressure to the forearm that is uncomfortable for the player. The shape also provides a raised and rounded end 214 adjacent the wrist of the player, such that when the wrist is laid back the back of the players hand rests against this raised and rounded "bumper" or "brace" which adds the function of stabilizing the wrist through contact with the ball thereby giving the player a sense of stability, power and increased confidence. Also this brace is firm but comfortable upon contact with the players hand so that the player does not experience any sharp edges or unnecessary pressure. The forearm body 204 also can include a ridge 216 shaped to be positioned between the forearm straps 200, 202. This ridge can keep the straps substantially in place, while allowing for some lateral movement of the straps in order to increase the level of comfort for the user.

The wrist positioning member 110 in this embodiment is shown to include a slightly elastic cord 210 positioned between the forearm attachment member 208 and the racket connector 112. The cord can be tied or otherwise fastened to the forearm connector 208. The cord can be made of any appropriate material, such as vinyl, rubber, or leather. The forearm connector in this embodiment is a rigid member having an extension member 600 (shown in FIG. 6) adapted to be received by one of the slots 206 in the forearm body 204. The extension member 600 can have a lip, or other shape, such that when the extension member is positioned in a slot 206 and pulled toward the racket, the extension member is held in the slot 206. It should be understood that a number of other ways for releasably attaching the wrist positioning member to the forearm attachment member can be used within the scope of the various embodiments, such as by using clips, clasps, snaps, ties, or any appropriate fastening mechanism. As can be seen in FIG. 6, the forearm connector 208 can have a C-shape with a portion 602 that is substantially parallel with the cord of the wrist positioning member when attached to the racket, such that the portion 602 acts as a lever allowing the racket to apply side-to-side pressure on the connection member. If the forearm connector is loosely held in the slot, or if the forearm connector includes a rotatable portion, the forearm connector 208 can be allowed to rotate in or about the slot 206 of the forearm body 204, allowing for some side-to-side movement of the racket. This can provide a more natural feel to the swing, providing some freedom of movement, while still holding the racket in the appropriate position. As referred to herein, the "appropriate position" and other such terms is meant to refer to a small range of positions over which the racket is determined to be in an acceptable position relative to the player. The racket is not limited to a single, precise position but can be allowed to move over a slight range to allow for a level of comfort and natural ease for the player.

As mentioned above, the cord 210 in this embodiment can be slightly elastic. This elastic is precisely measured in length and stretching characteristics so that there is a balance as to the amount of elasticity allowed in the tether. The more elasticity in the cord the greater the stretching characteristics and the less limiting or hold back there is in the player's tennis stroke. Having the cord too elastic, allows the racket to move out of an acceptable position, and can allow the player to attempt to "push" the ball by flexing the wrist which is an incorrect tennis ball stroking movement. One way to allow the user to adjust the amount of tension applied through the cord is to use a tension control member 212. As shown, the tension control member 212 can be a small piece, such as a band or bar made out of a material such as plastic, which connects between portions of the cord in order to control the amount of tension in the cord. As closer view 400 can be seen in FIG. 4. As shown, the member 212 can be slid toward the racket end to increase tension, and can be slid toward the player to reduce tension. The tension control member can include a releasable mechanism, such as a spring-loaded button, that allows the user to move the member to adjust tension, but that prevents the member from moving when the user releases the member in the desired position.

Figure 3:
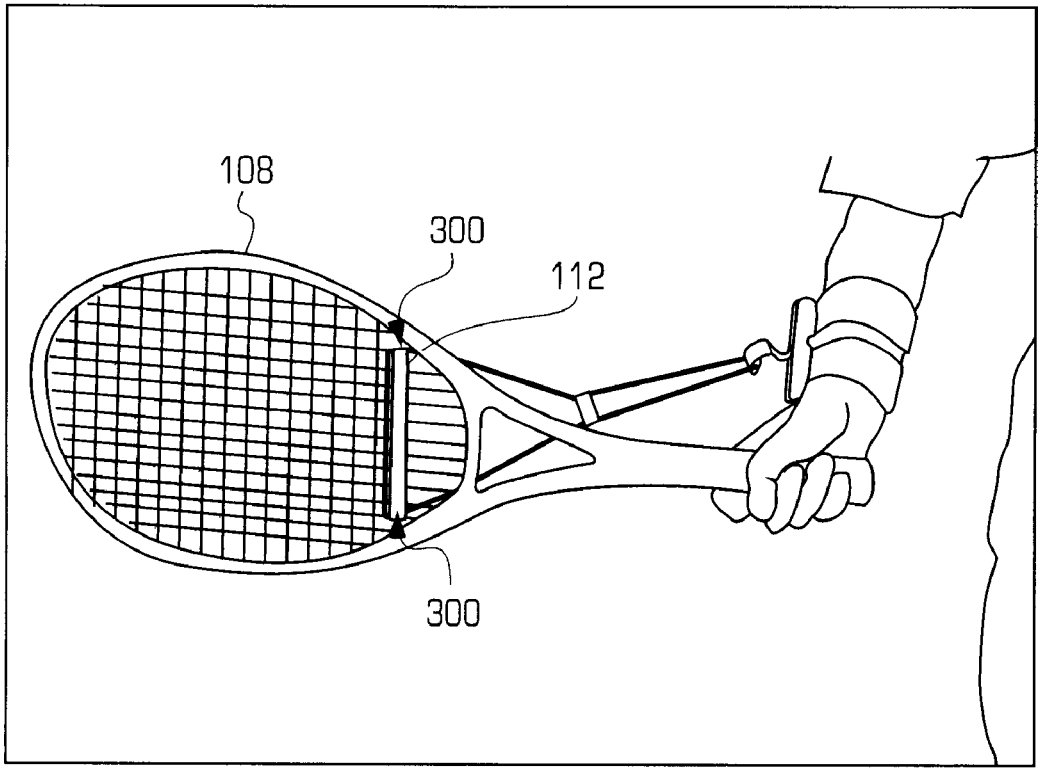
FIG. 3 is another view of the tennis training aid of FIG. 1.

The racket connector 112 in this embodiment is an elongated U-shaped member made of a substantially rigid material, such as plastic or aluminum. As shown in FIG. 3, the racket connector can be shaped to fit in gaps 300 between the strings of a standard tennis racket. As can be seen in FIGS. 1 and 2, each end of the racket connector can have a lip, groove, or other mechanism for receiving and connecting the wrist positioning member to the racket. In this embodiment, each end of the racket connector has a groove shaped to receive the cord 210, such that the cord loops from one end of the racket connector to the other, thereby applying a substantially even force to both sides of the racket and preventing the racket from pivoting about the axis of the handle. There can be any of a number of other ways of attaching the wrist positioning member to the racket, with varying degrees of success. For example, there can be separate racket connectors, such as clamps, that attach to each side of the racket, or to the strings of the racket, for receiving the cord. There also can be connectors that are part of the racket. Alternatively, the cord of the wrist positioning member can be configured to wrap around each side of the racket, or about the strings, and attach to itself via a tie or clasp, without requiring an additional connection mechanism. Other connection approaches would be obvious to one of ordinary skill in the art in light of the discussion herein.

Such a device can be used to help a player achieve the desired movement for a forehand ground stroke. The device can control the player's wrist movements, substantially preventing improper wrist movement, while maintaining the proper position of the racket. The forearm attachment member, which can be a removable orthosis such as a brace or splint, can be used with the wrist positioning member to hold the wrist in a proper position during the full swing. The wrist positioning member can pull on the racket and consequently position the player's wrist in the desired position of extension. The device can be comfortable for the player while gripping the racket and taking a full swing at the ball.

The forearm attachment member, which again can be a removable orthosis such as a brace or splint, also can be used to hold the wrist in proper position during a two-handed backhand swing. The wrist positioning member can be attached to the racket in the same way in order to position the player's wrist in the desired position of extension. The training aid can be worn while hitting the tennis ball and made to be uniquely comfortable so that the player is comfortable gripping the racket and taking a full swing at the 2-handed backhand.

Such a device also can be worn equally well on the non-dominant hand to set the wrist at the preferred 40-75 degree "extension" of the wrist for that hand, as is desirable for a two-handed backhand. Fixing the non-dominant wrist at this desired angle can allow the player to have solid ball contact, improved accuracy/consistency, improved racket stability, improved control, and an overall improved technique while hitting a two-handed backhand.

In essence, the non-dominant wrist can be used like the wrist on the forehand ground stroke, whereby an initial angle of 40-75 degrees of "extension" is employed during the stroke. The device also can greatly reduce any "flexion" of the wrist while swinging.

As discussed above, players also can have problems with achieving proper form during a volley. It can be desirable to set the wrist and racket angle in an initial upward position, such as a position that is not quite vertical but somewhere halfway between vertical and across, with the tip pointed away from the player. It also can be desired to restrict downward movement of the wrist during the volley stroke. This downward movement is called ulnar deviation, whereby the player keeps his/her hand facing the ball but incorrectly drops the wrist position during the stroke. A device including a forearm attachment member as described above can be used to greatly reduce ulnar deviation of the wrist during the volley stroke and make it simple for the player to keep the racket pointed diagonally upward. This volley device can pull upward on the racket, not allowing the racket to drop.

Figure 7:
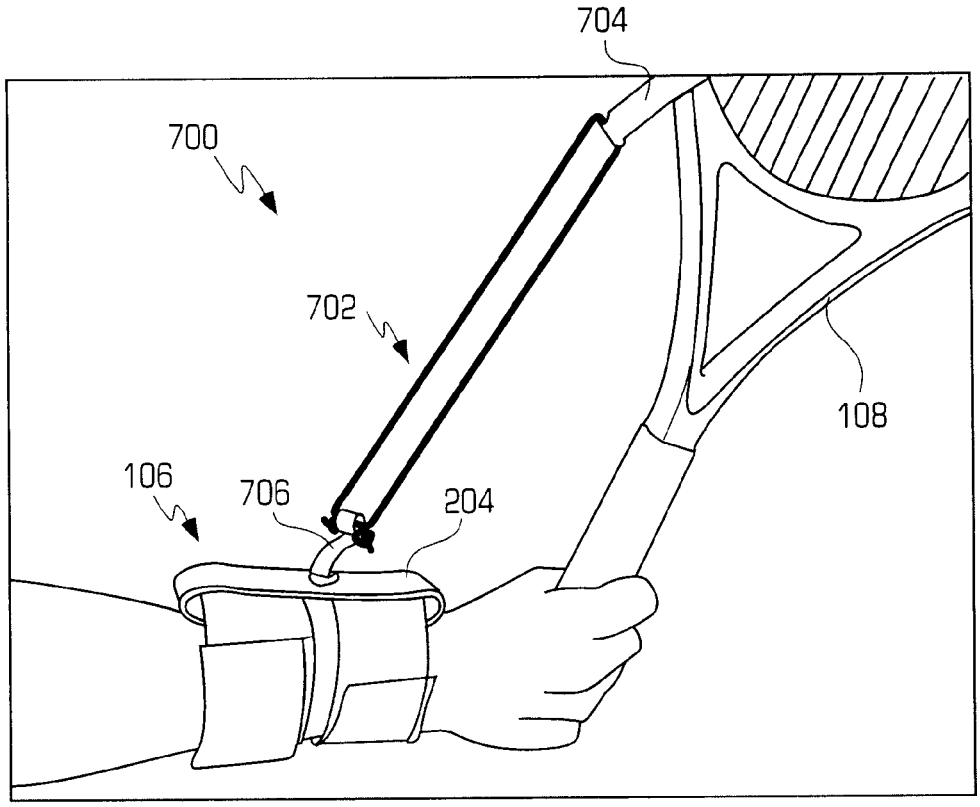
FIG. 7 is a view of a tennis training aid that can be used in accordance with another embodiment of the present invention.
Figure 8:
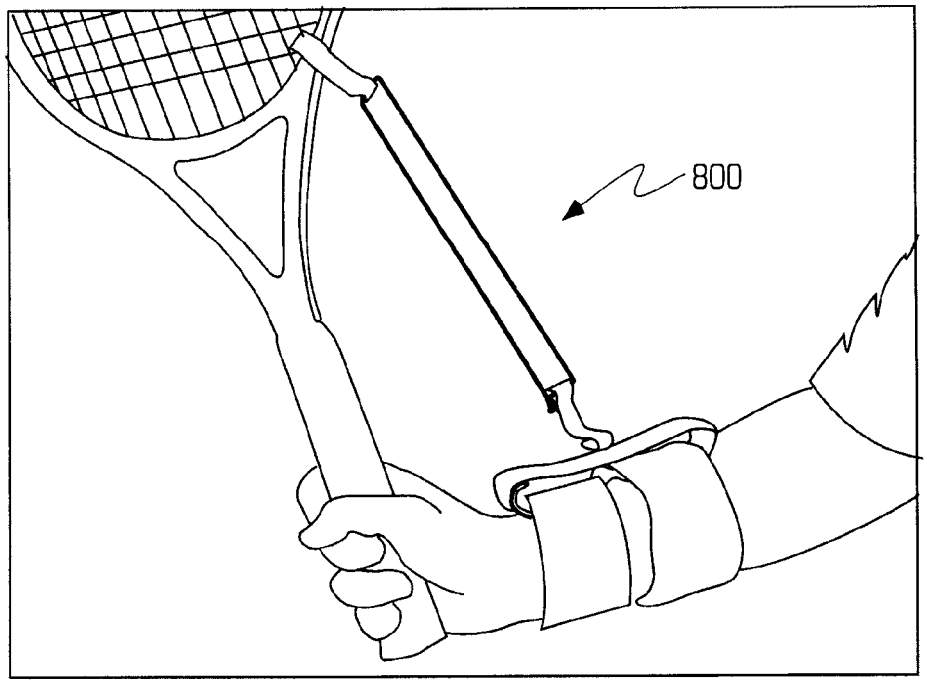
FIG. 8 is another view of the tennis training aid of FIG. 7.

FIG. 7 shows such a volley training aid 700. In this embodiment, the device includes the same (or a similar) forearm attachment member 106 described above for use with the forehand ground stroke and/or two-handed backhand stroke. The volley device, however, can include a different wrist positioning member 702 for connecting the racket 108 to the forearm attachment member 106. In this embodiment, the forearm attachment member 106 is rotated so that the forearm body 204 is on the same side of the forearm as the player's thumb, instead of being aligned with the middle knuckles as for the forehand ground stroke. Another view 800 of the alignment is shown in FIG. 8.

Figure 9:
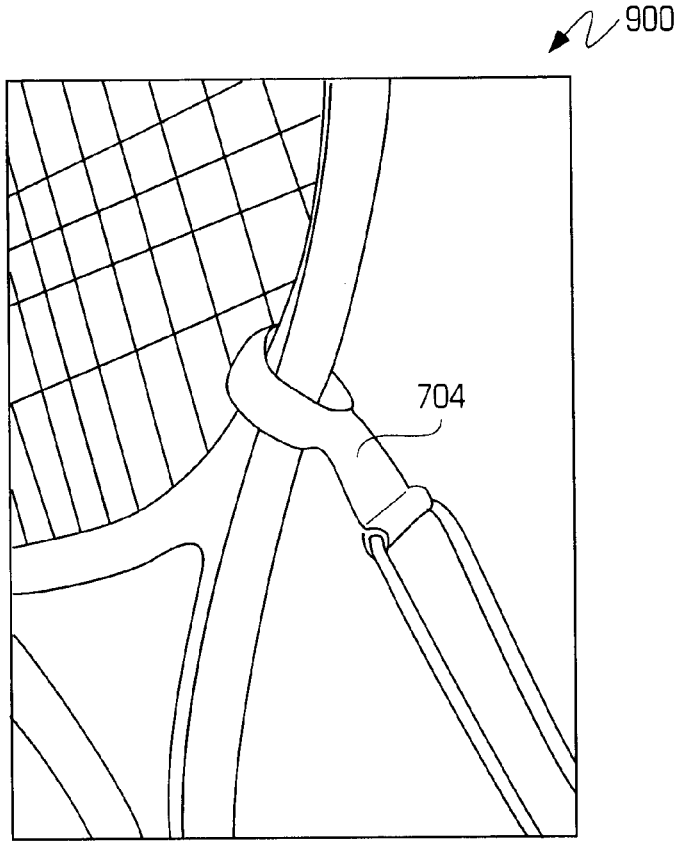
FIG. 9 is another view of the tennis training aid of FIG. 7.
Figure 10:
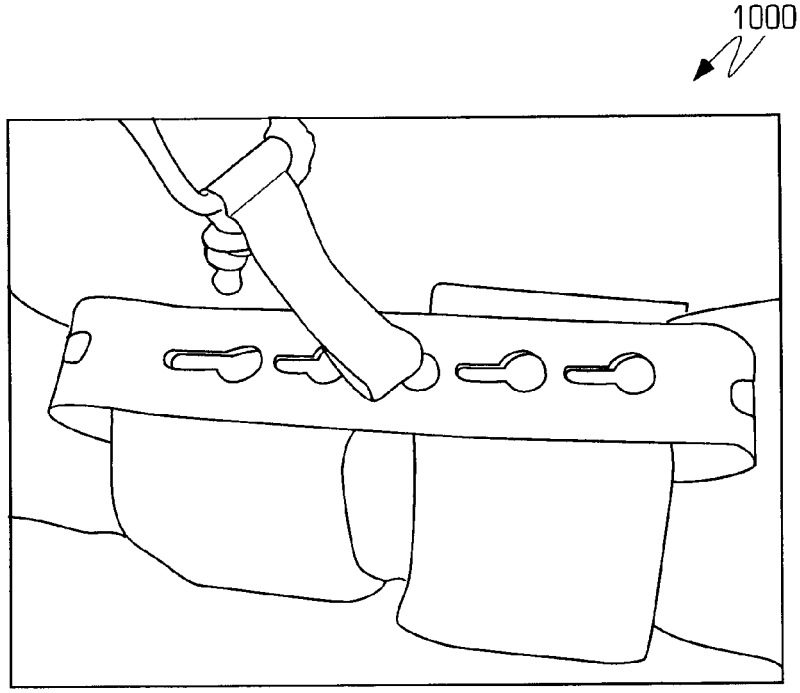
FIG. 10 is another view of the tennis training aid of FIG. 7.

The wrist positioning member 702 connects between the slots in the forearm body 204 and a single side of the racket 108. Here, a single racket connector 704 is used to attach the wrist positioning member to a side of the racket. This racket connector 704 is shown to attach about a side of the racket frame, but could attach at any appropriate place as listed above, such as between or around a string(s) of the racket 108. A closer view 900 of the racket connector is shown in FIG. 9. The wrist positioning member again can include a cord or other elongated material, which can have an amount of elasticity as described above. The racket connector 704 can be a separate element, or can be part of the racket connector(s) used for the forehand ground stroke and/or two-handed backhand stroke. The racket connector 704 can be made of any appropriate material, such as plastic, leather, vinyl, or cloth, and can attach to the racket using any appropriate connection means, such as a tie, snap, clasp, or button. The forearm connector 706 of the wrist positioning member again can be a rigid member having an extension member adapted to be received by one of the slots in the forearm body. The forearm connector 706 can have a C-shape with a portion that is substantially parallel with the wrist positioning member when attached to the racket, such that the member acts as a lever allowing the racket to apply side-to-side pressure on the forearm connector, whereby the forearm connector can rotate with respect to the forearm body. A rotated forearm connector 706 is shown in the view 1000 of FIG. 10.

Such a device can be used to keep the wrist in the desired position, and to help the player control wrist position and reduce ulnar deviation during a volley. The wrist positioning member 702 can help to keep the racket in a diagonally upward position when used for the volley stroke, and can help the player greatly reduce downward movement of the wrist during the entire stroke. The wrist positioning member can attach to the side of the racket at any appropriate location, such as at the throat or shoulders as referred to in the art. The wrist positioning member alternatively can attach at any other appropriate location on the racket for maintaining the racket in the desired half-up position throughout the stroke. It also is possible to use both the forehand and volley wrist positioning members together, in order to teach proper wrist position for a forehand volley.

Although the figures show the device(s) being used on the right hand, the forearm portions can be designed to be worn equally well with the left hand, allowing one device to be used for training a number of players regardless of the preferred hand of a player. The forehand, backhand, and/or volley devices can be symmetrical so as to be used with either hand equally well, and to be equally comfortable in both cases. In addition, when using the device for two-handed backhands, a player simply can wear the device on the non-dominant hand and practice that particular stroke. For example, a right-handed player can wear the device on the left hand while practicing a two-handed backhand.

Figure 11:
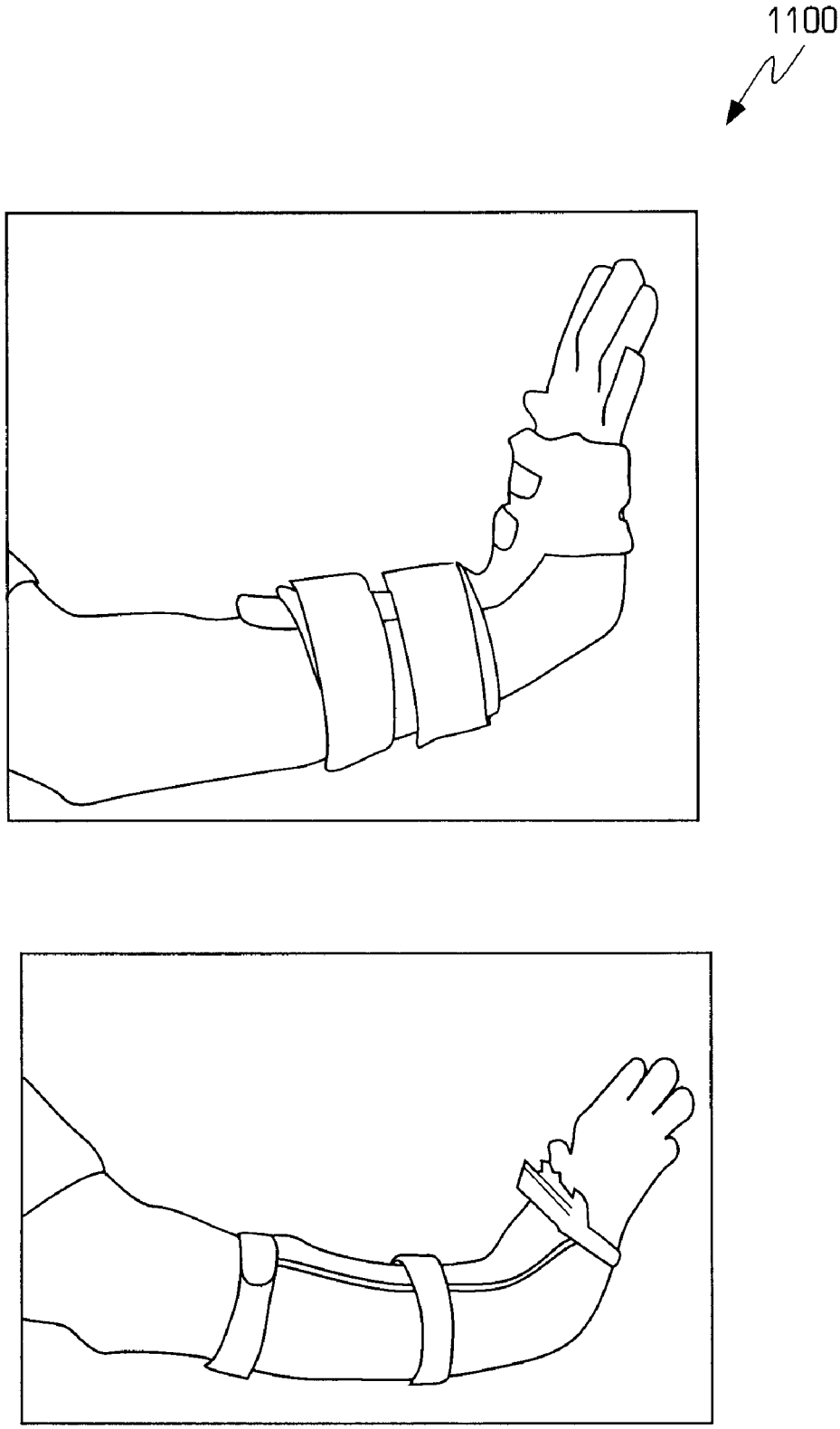
FIG. 11 is a view of an alternative forearm attachment member that can be used with the tennis training aids of FIGS. 1 and 7.

In another embodiment, the forearm attachment member can include a hand extension 1100 as shown in FIG. 11. The hand extension can be designed to extend from the forearm to a region near the knuckles of the player. The extension can be formed at an angle relative to the forearm of the player, in order to maintain the wrist of the player bent at an appropriate angle, as described above. This extension can attach around the hand of the user using straps or other devices such as those described above for attaching the forearm attachment member. The hand extension can be used with the device(s) described above, or can be used in place of the wrist positioning members, as the wrist can be held at the desired angle such that the wrist positioning members may not be necessary. The angle of the extension portion also can be adjustable using mechanisms such as those described above for altering and/or maintaining position.

FIGS. 12*a-d* illustrate another embodiment of a tennis training aid 1200, according to the present invention. In this embodiment, forearm body 204 and wrist positioning member 110 are replaced by a rigid, lightweight forearm body

1240 and a wrist positioning member 1210, respectively. In this embodiment, wrist positioning member 1210 includes a Y-shaped tether 1220.

Forearm body 1240 comprises locking mechanism 1242 and volley attachment hook 1244. As discussed below, the volley attachment hook 1244 allows the tennis training aid 1200 to operate as a 2-in-1 trainer that easily adjusts for all ground strokes and volleys. In one embodiment, a pair of volley attachment hooks, one located on each side of the forearm body 1240 may be used. Each hook 1240 may be on a side of the body to line up the edge of the racket so that a user gets a direct upward pull on his wrist (or so that the wrist cannot move down below the position that is set). The dual hook arrangement allows for both a left-handed or right-handed volley configuration with equal ease.

Figure 12A:
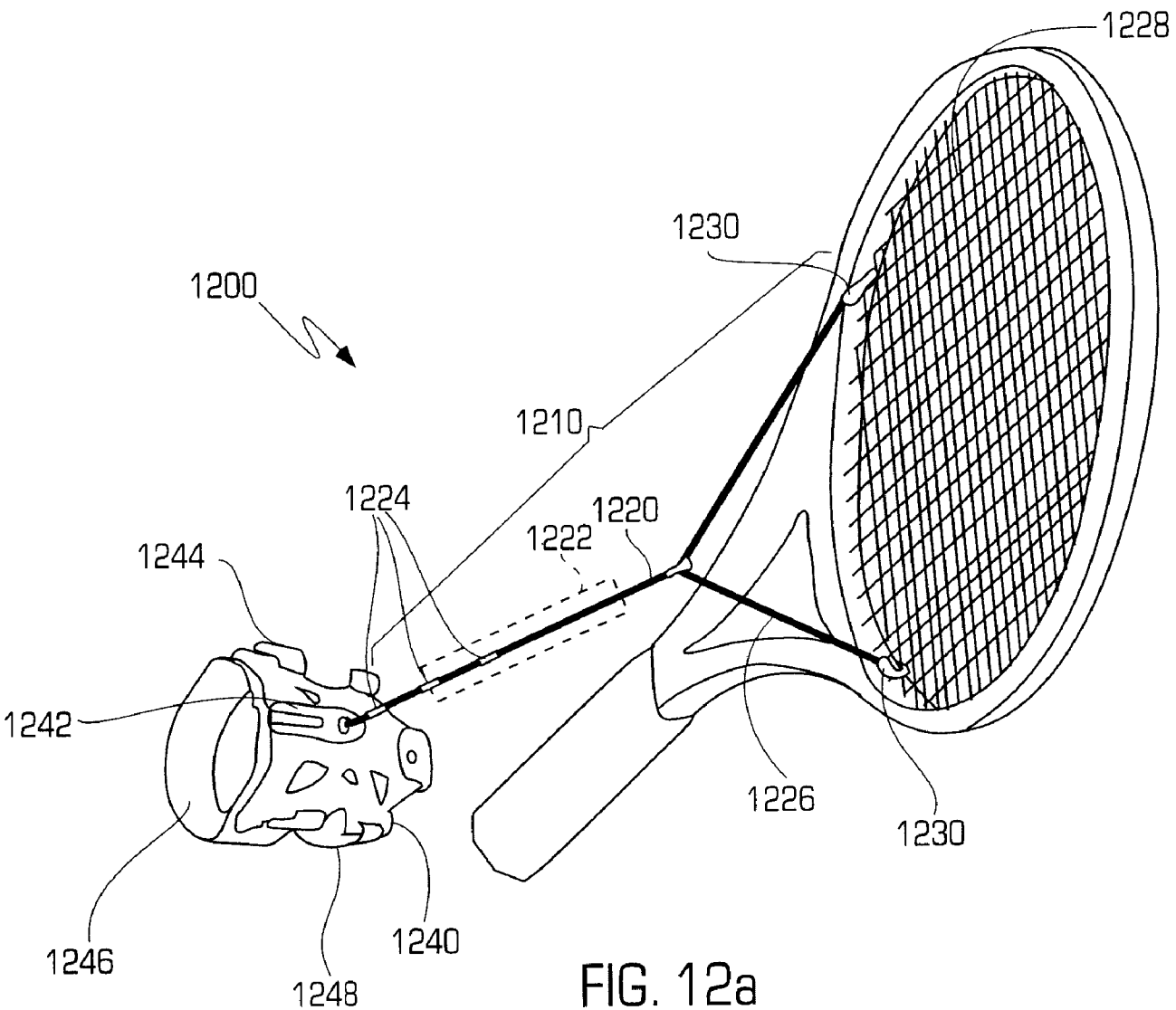
FIG. 12*a* illustrates an alternate embodiment of the present invention.
Figure 12B:
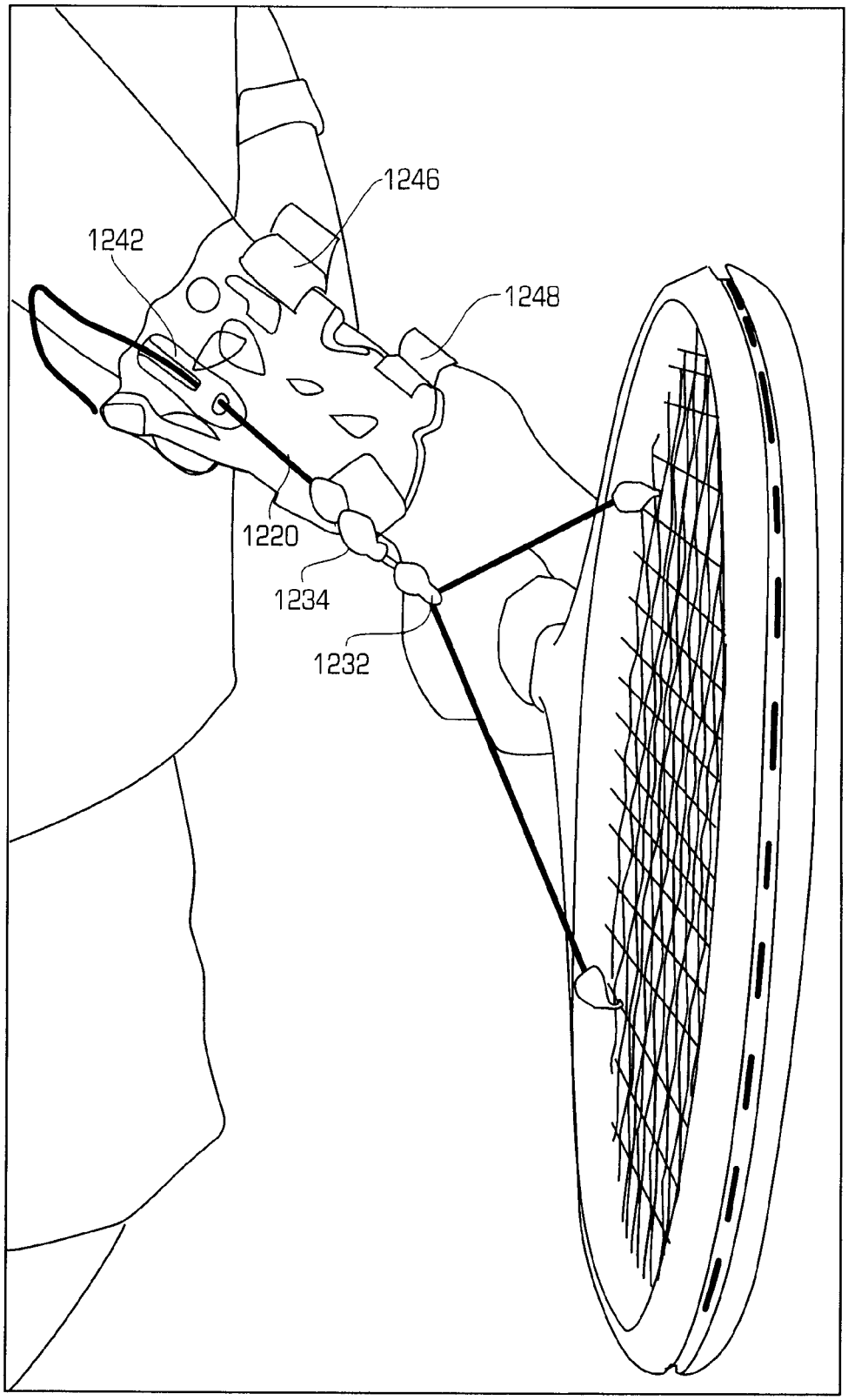
FIG. 12*b* is a view of the alternate embodiment of FIG. 12*a* configured in a usage mode for practicing a forehand stroke.

Forearm body 1240 is preferably made from a molded plastic or nylon compound that is anatomically shaped, with a half-cuff that rests on the lower forearm as a platform for attachment of the tether 1220. Two, sufficiently wide and padded, Velcro® closure straps 1246, 1248 are coupled to the body 1240. Strap 1248 is located near the distal portion of the body 1240 that engages a user's wrist, as shown in FIG. 12*b*. Strap 1246 is located near the proximal portion of the body 1240 that engages a user's mid-forearm, as shown in FIG. 12*b*. Straps 1246, 1248 provide a comfortable and easily removable attachment to the user's arm and are flexible and adjustable so as to comfortably fit arms of various sizes. In one embodiment, the straps 1246, 1248 may include logos that a player may use as pull tabs for donning the cuff. In an alternate embodiment, the forearm body comprises a full cuff with an attachment allowing the tether 1220 to be placed under and around to the top of the forearm.

In one embodiment, a non-slip, padded, neoprene-type material may be attached to or integrated into the interior cuff of the body 1240 for engaging a user's forearm. The material may comprise open-cell and/or perforated material that breathes air and allows for evaporation of perspiration. Additional padding or a gel pouch may also be disposed at distal portion of the body 1240 near a user's wrist to provide a comfortable "bumper" or "brace" on the dorsal hand at full wrist flexion, which adds important function as well as comfort.

Tether 1220 includes a first portion 1222 that includes a plurality of colored markings 1224 that allow a user to easily engage the positioning member at precise locations corresponding to different usage modes or set-up positions, such as a forehand position, a backhand position and a volley position. In one embodiment, the first portion 1222 of the tether further includes an elastic insert or member 1234, which reduces shock and enables a realistic release allowing the tennis training aid to function smoothly and comfortably. The tether with its embedded elastic allows for nearly an infinite amount of adjustments as opposed to a few limited or pre-set adjustments.

Tether 1220 further includes a second portion 1226 that includes a pair of string hooks 1230 that selectively connect to racket strings 1228. The second potion 1226 of the tether 1220 is slidably coupled to the first portion 1228 of the tether 1220, for example, by use of a threaded plastic eyelet 1232. The "Y"-shaped tether 1220 and slidable coupling accommodates different racket face angles and distributes the load from ball contact evenly.

Hooks 1230 are preferably plastic "clip on" type hooks that are easily deployable and allow for a quick release. Hooks 1230 attach the tether 1220 to the tennis racket strings on opposing sides of the racket to create an accurate volley grip and set-up. The string hooks preferably include a small detent to provide a firm hold. String hooks 1230 are also preferably pliable in order to firmly engage all standard string gauges, while preventing damage to tennis racket strings. The string hooks 1230 allow attachment of tether to the tennis strings in a variety of locations for versatility of player drills. In other embodiments, the hooks 1230 may be replaced by other conventional attachment members for attaching the tether to the racket strings, sides of the racket, throat of the racket, or to the top of racket handle.

As illustrated, tether 1220 locks onto forearm body 1240 by use of a fastening or locking mechanism 1242. The type of swing a user desires to practice will dictate where in locking mechanism 1242 tether 1220 should be fastened. Moreover, a user may lock tether 1220 onto locking mechanism 1242 according to colored markings 1222, wherein individual colored markings 1222 correspond to particular usage modes or strokes. For example, a red marking may correspond to a forehand stroke, shown in FIG. 12*b*, a black marking may correspond to a two-handed backhand stroke, shown in FIG. 12*c*, and a green marking may correspond to a volley stroke, shown in FIG. 12*d*, where the slack portion of tether 1220 may be secured around volley hook 1244 as shown. In other embodiments, different types of coding may be used to correspond to different types of usage modes or strokes.

Locking mechanism 1242 is preferably located near the proximal end of the body 1240. This location allows the tether to be attached near a user's forearm (not to the wrist). This location creates a correct pulling angle on the racket for proper wrist lay back. This combined with the "Y" tether design keeps the racket square through the hitting zone and does not allow the wrist to drop inappropriately. The tether angle is much improved over other products since it is angled steeper away from the arm because it attaches higher up the cuff/forearm, thereby giving a stronger leverage on the tennis racket. Moreover, while the device will typically pull the wrist back about 40-75 degrees, the releasable locking mechanism and tether will actually allow for nearly an infinite number of adjustments.

Locking mechanism 1242 may be embodied in various ways. In one embodiment, a "marine-type" line and cleat ("jam cleat") mechanism is used. In such an embodiment, when downward pressure is placed on tether 1220 at the same time as a user's wrist cocks forward, tether 1220 is tightly locked into the jam cleat to hold the racket in the desired position. In another embodiment, a "cam lock-type" line and cleat mechanism is used. In such an embodiment, tether 1220 feeds under and through this cam mechanism and, by pushing down on tether 1220 with this cam lock, tether 1220 is pinched down and locked into place. In one embodiment, the jam cleat includes a stamped arrow or triangle on top of the bridge that may be aligned with coded portion of the tether to denote accurate, micro-tether adjustment settings. In alternate embodiments, other conventional fastening mechanisms may be used to anchoring the tether to the top of the cuff such as hook-and-ladder; peg-in-slot and male-female clips.

In operation, a user may slide the forearm body 1240 over the user's playing hand (proximal end first) and set the distal end just behind the wrist bone (styloid). A user may then tighten and fasten strap 1248, followed by strap 1246, so that the forearm body 1240 is comfortably, but firmly positioned on the user's forearm. The user then pulls the slack out of the tether 1220 to the desired laid-back or up-cocked wrist position. The color coded portions 1224 may guide the user in this process. The user will then push down on the tether 1220 to engage it with the locking mechanism 1240 (e.g., jam cleat). The user can then cock his wrist forward to lock the tether into the jam cleat.

For practicing a forehand stroke, the user may attach both string hooks 1230 to the second cross string at the outermost points on the second string closest to the frame, as shown in FIG. 12*b* (or another desired cross string, which may depend, for example on the racket and user preference). The user will hold the racket in a forehand grip until the corresponding colored mark 1224 (e.g., a red mark) appears in the jam cleat 1240. The user then pulls the remaining slack out of the tether and locks it in place. The tennis training aid 1200 will then guide the user through a proper forehand stroke motion, while keeping the wrist at an optimal angle.

For practicing a one-handed backhand stroke, the user may use the same set-up as a forehand stroke. With the racket cradled in a forehand grip, the user may simply rotate the racket counter-clockwise until the racket sits in a proper one-handed backhand position. In this position, the string hooks 1230 and "Y" tether 1220 will sit behind the racket face. Holding the racket in the correct one-handed position, the tennis training aid 1200 will guide the stroke as the user accelerates from low to high through the tennis ball, while keeping the wrist at an optimal angle. The tether 1220 with its embedded elastic pulls the wrist back and up throughout a full range of motion. On ground strokes this may range from less than 40 degrees of wrist pull back to up to and beyond 70 degrees of wrist pull back.

Figure 12C:
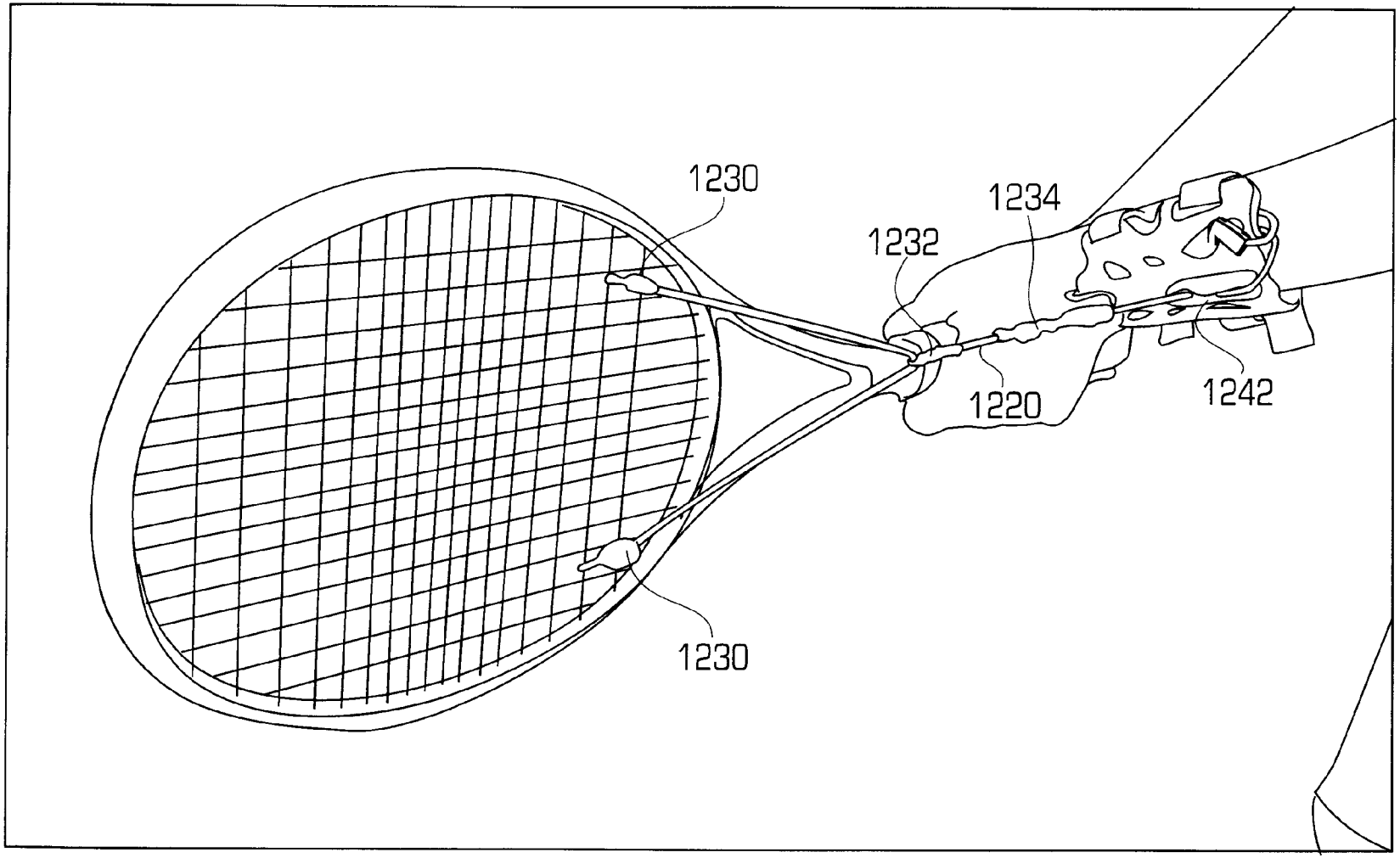
FIG. 12*c* is a view of the alternate embodiment of FIG. 12*a* configured in a usage mode for practicing a two-handed backhand stroke.

For practicing a two-handed backhand stroke, the user may attach the tennis training aid 1200 to the non-dominant forearm, as shown in FIG. 12*c*. The set-up procedure will be substantially similar to the forehand set-up procedure with the exception that a different corresponding colored mark 1224 (e.g., a black mark) will be aligned with the jam cleat 1240.

Figure 12D:
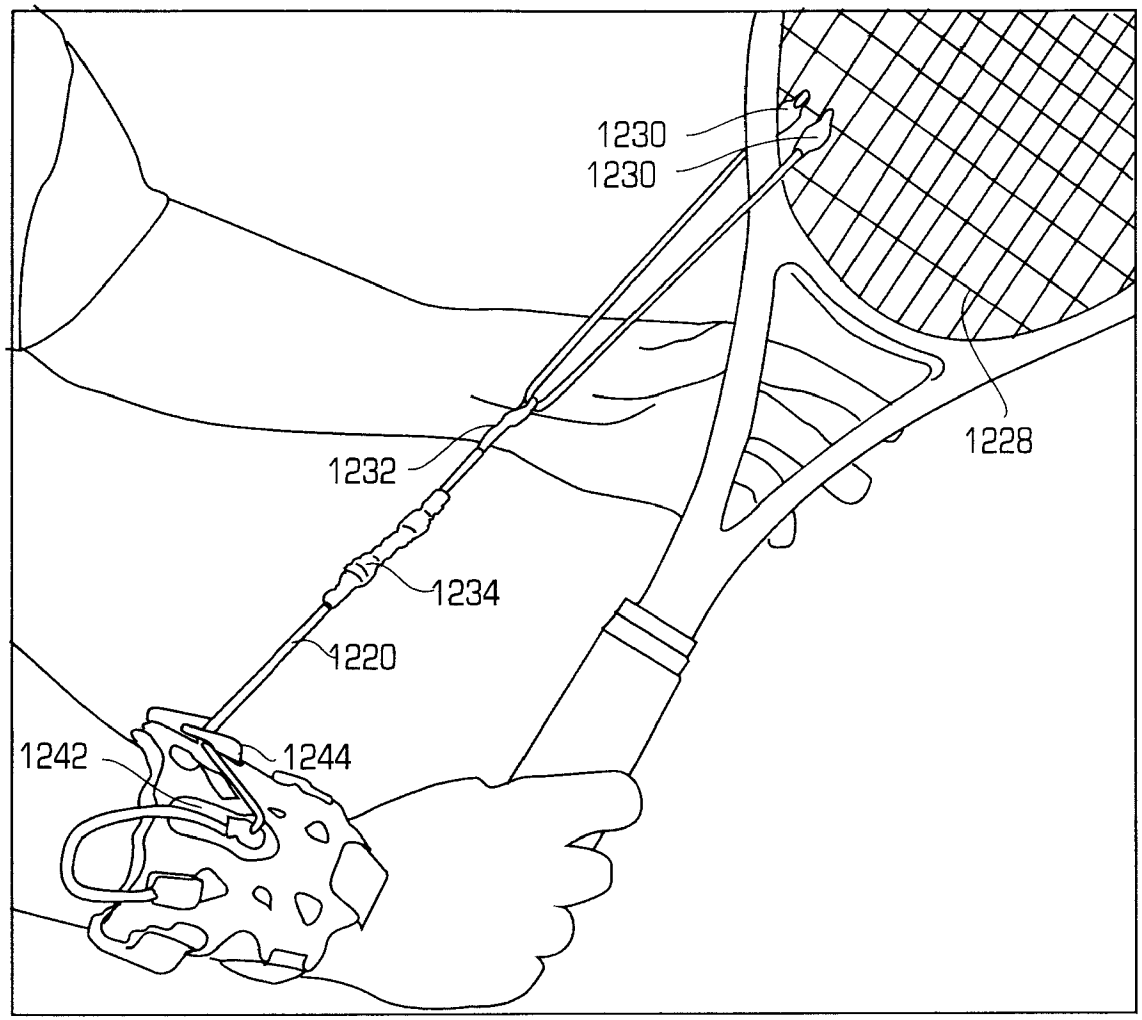
FIG. 12*d* is a view of the alternate embodiment of FIG. 12*a* configured in a usage mode for practicing a volley stroke.

For practicing volleys, the user may begin in the forehand position. From the forehand position, the user may remove the bottom string hook 1230, move it over the racket and connect it to the string on the opposite side of the racket, as shown in FIG. 12*d*. The user will then align a different corresponding colored mark 1224 (e.g., a green mark) with the jam cleat 1240 and lock into position. The user will swing the slack portion of tether 1220 around volley hook 1244. In this position, the tether 1220 will pull up the edge of the racket to a correct position for practicing a volley stroke. In an alternate embodiment, a user may switch into a volley usage mode in a faster setup" by simply shifting to a volley grip and tightening the tether by pulling the front end of the tether around the volley hook resulting in the racket cocking upwards. In this way, the user does not have to move the string hooks or swing them around the racket.

In this manner, the present invention allows a user to move from a ground stroke training mode to a volley training mode, while being equally beneficial in improving both strokes. The tether and locking mechanism position the wrist back for ground strokes and the tether and volley attachment hook cooperatively position the wrist up for volleys. The present invention adjusts to fit each person individually and also adjusts for each different tennis stroke.

Figure 13A:
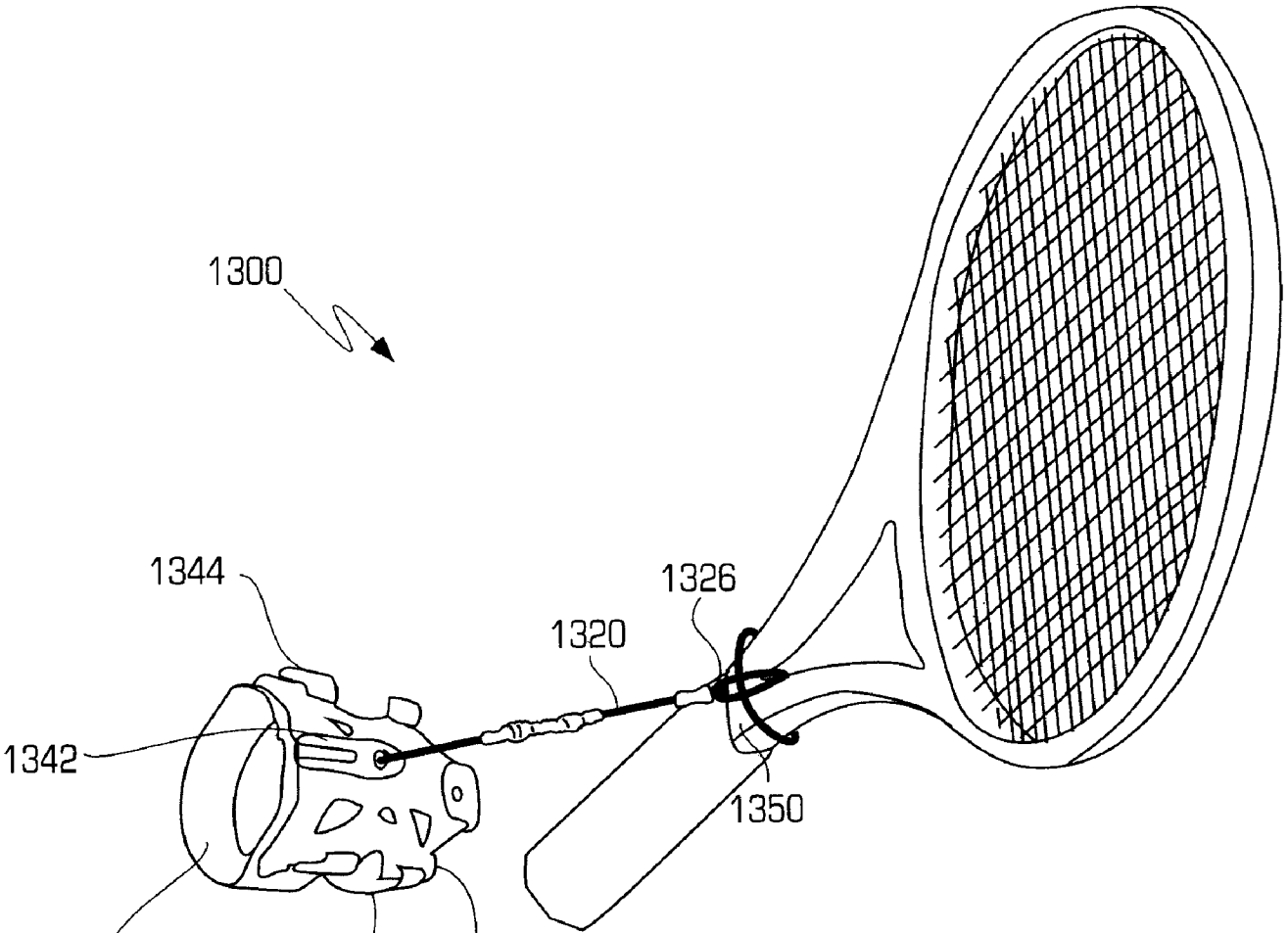
FIG. 13*a* illustrates an alternate embodiment of the present invention.

In FIG. 13*a*, an illustration of another embodiment of the present invention is provided. Similar to the embodiment illustrated in FIG. 12*a*, the tennis training aid 1300 shown in FIG. 13*a* includes a forearm body 1340 comprising a locking mechanism 1342 and straps 1346, 1348, as shown. Tennis training aid 1300 also includes a tether 1320 coupled to forearm body 1340 via locking mechanism 1342, wherein tether 1320 may further include a second portion 1326, as shown. Unlike tennis training aid 1200, however, tether 1320 attaches to racket throat 1350 instead of to racket strings 1228.

The design of tennis training aid 1300 provides some advantages over the design of tennis training aid 1200, including simplification of use and better all around feel and function. The design of tennis training aid 1300, for example, eliminates the need for volley attachment hooks 1244, string hooks 1230, and tether set up via color coded markings 1224. The functionality of tennis training aid 1300 is also greatly improved because the same tension/pull-back on tether 1320 may be used for all ground strokes and volleys instead of having to adjust tether 1320 to accommodate each unique tennis stroke.

Figure 13C:
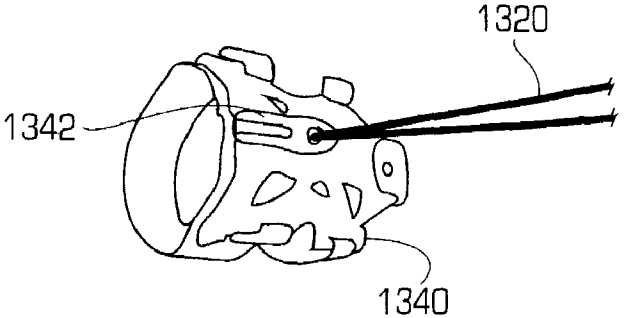
FIG. 13*c* is an illustration of a dual-tether embodiment of the present invention.
Figure 13D:
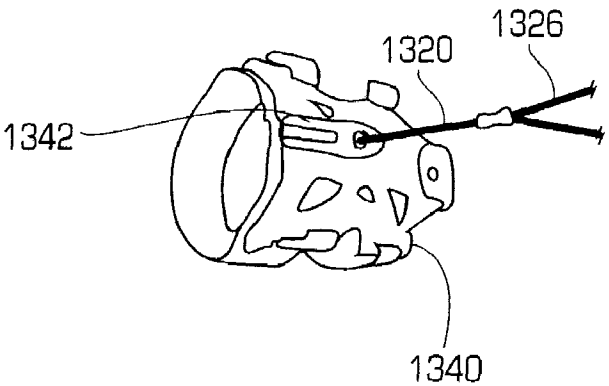
FIG. 13*d* is an illustration of a Y-tether embodiment of the present invention.
Figure 13B:
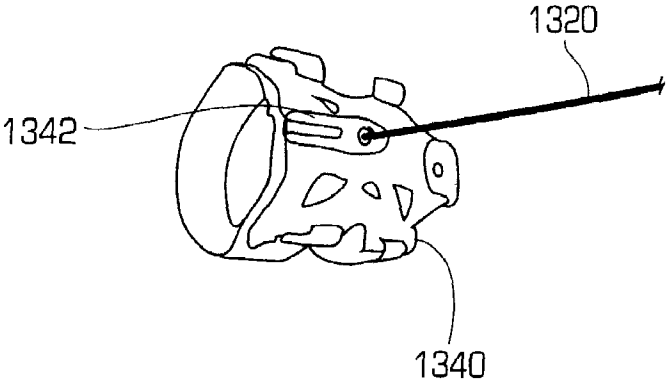
FIG. 13*b* is an illustration of a single-tether embodiment of the present invention.

It should also be appreciated that tennis training aid 1300 may include various types of embodiments for tether 1320. In FIG. 13*b*, for example, an illustration of a single-tether embodiment is provided. A dual-tether embodiment, however, may also be implemented as shown in FIG. 13*c*, wherein tether 1320 and 1328 are each coupled to forearm body 1340 via locking mechanism 1342. In FIG. 13*d*, yet another embodiment is provided, wherein tether 1320 comprises a Y-shaped portion 1326.

Figure 13E:
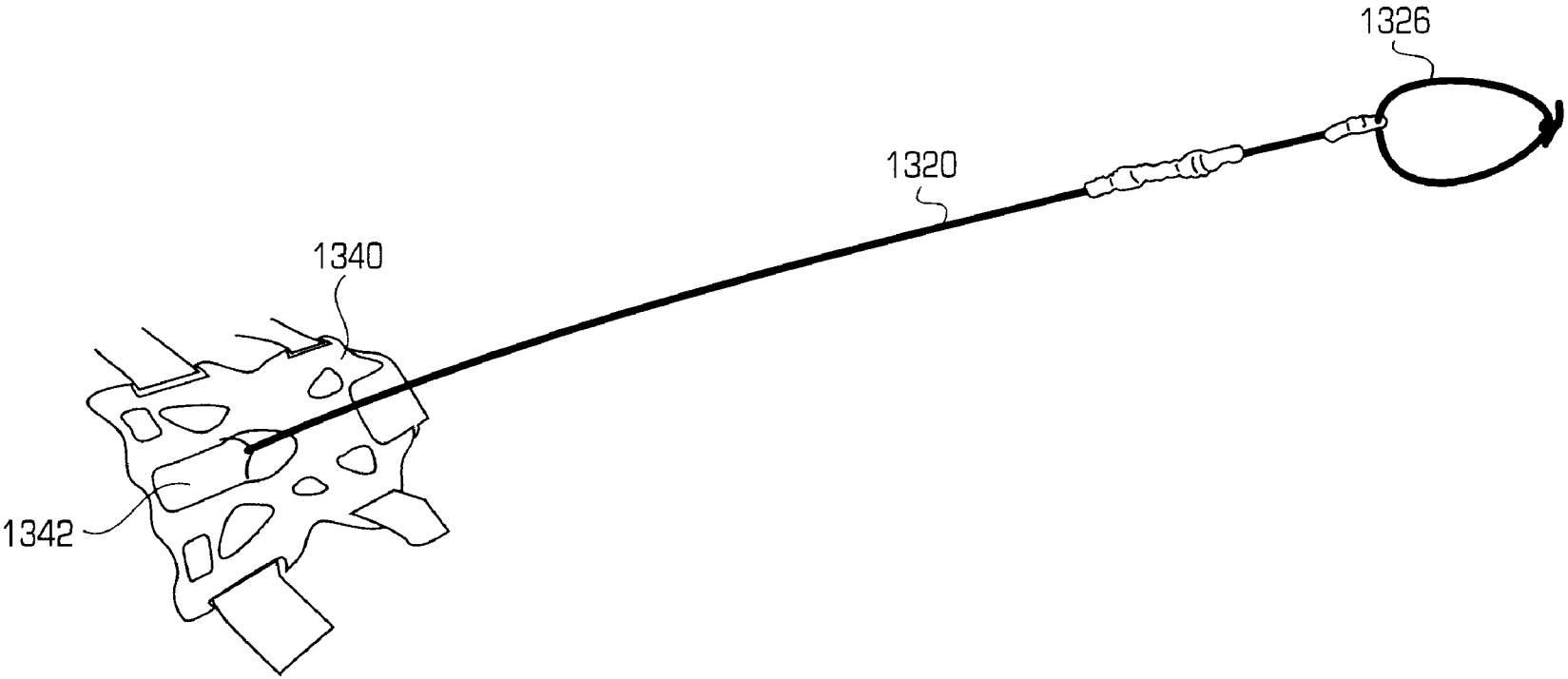
FIG. 13*e* is an illustration of a first step for attaching a tether to the throat of a racket according to a preferred embodiment.
Figure 13F:
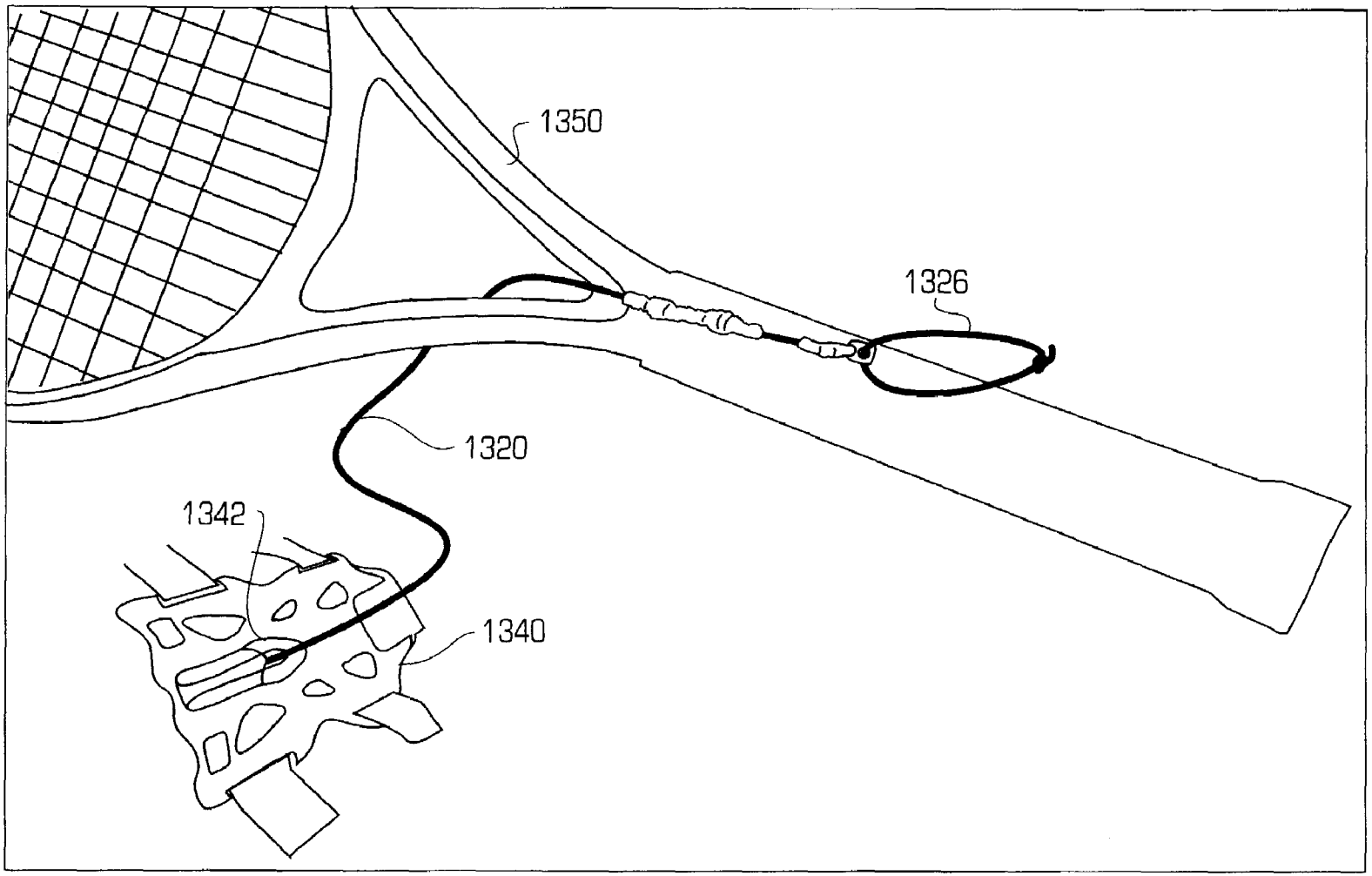
FIG. 13*f* is an illustration of a second step for attaching a tether to the throat of a racket according to a preferred embodiment.
Figure 13G:
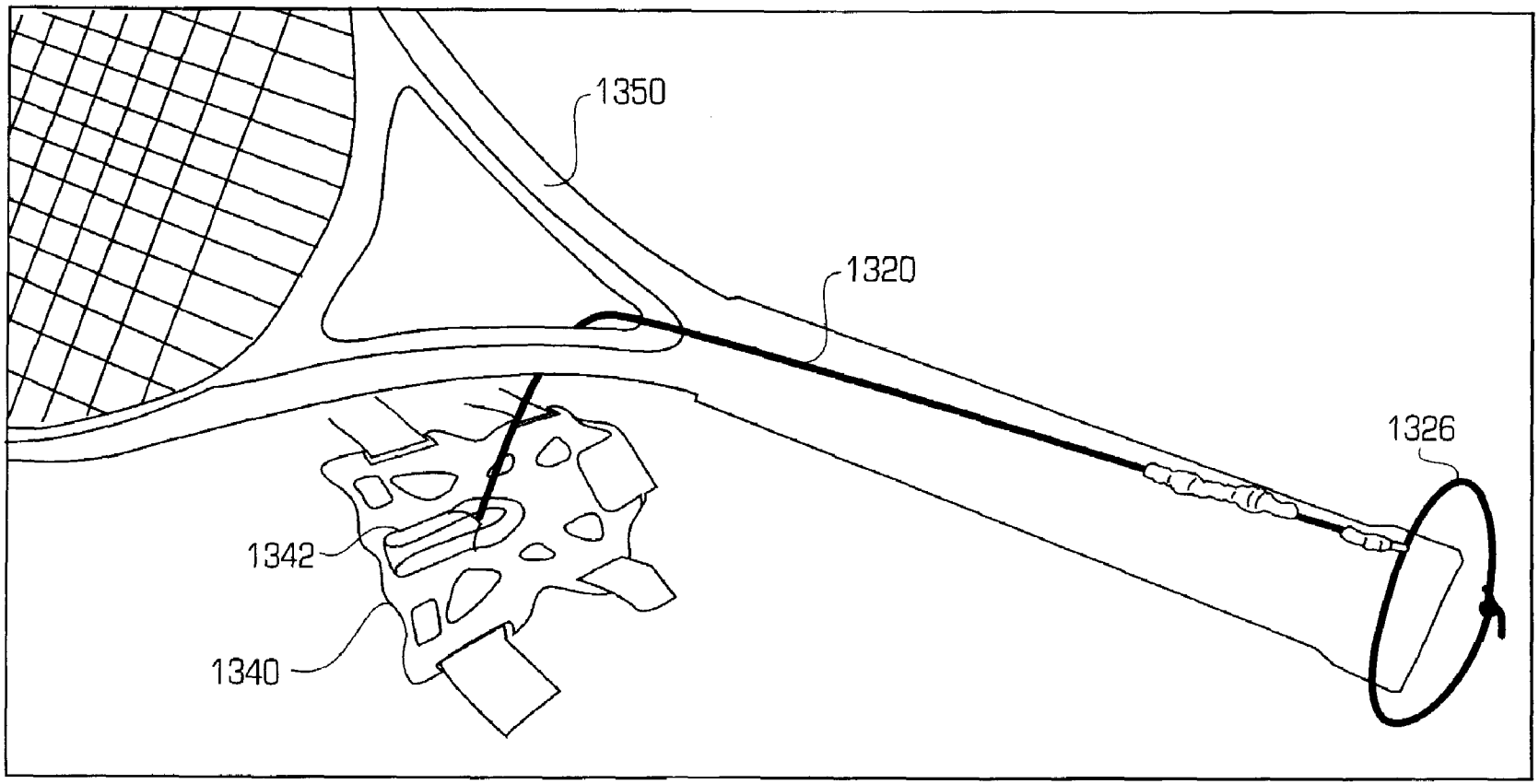
FIG. 13*g* is an illustration of a third step for attaching a tether to the throat of a racket according to a preferred embodiment.
Figure 13H:
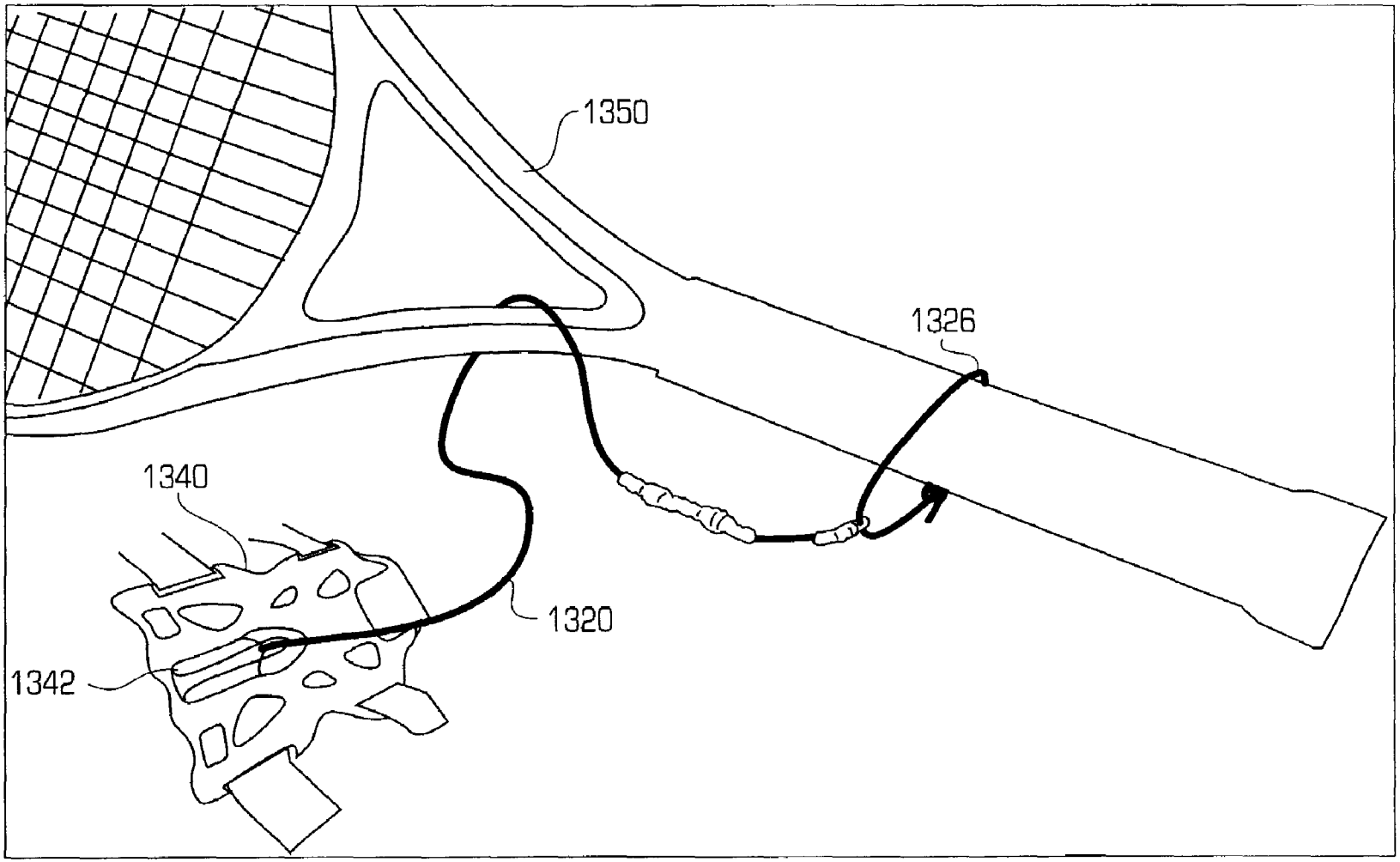
FIG. 13*h* is an illustration of a fourth step for attaching a tether to the throat of a racket according to a preferred embodiment.
Figure 13I:
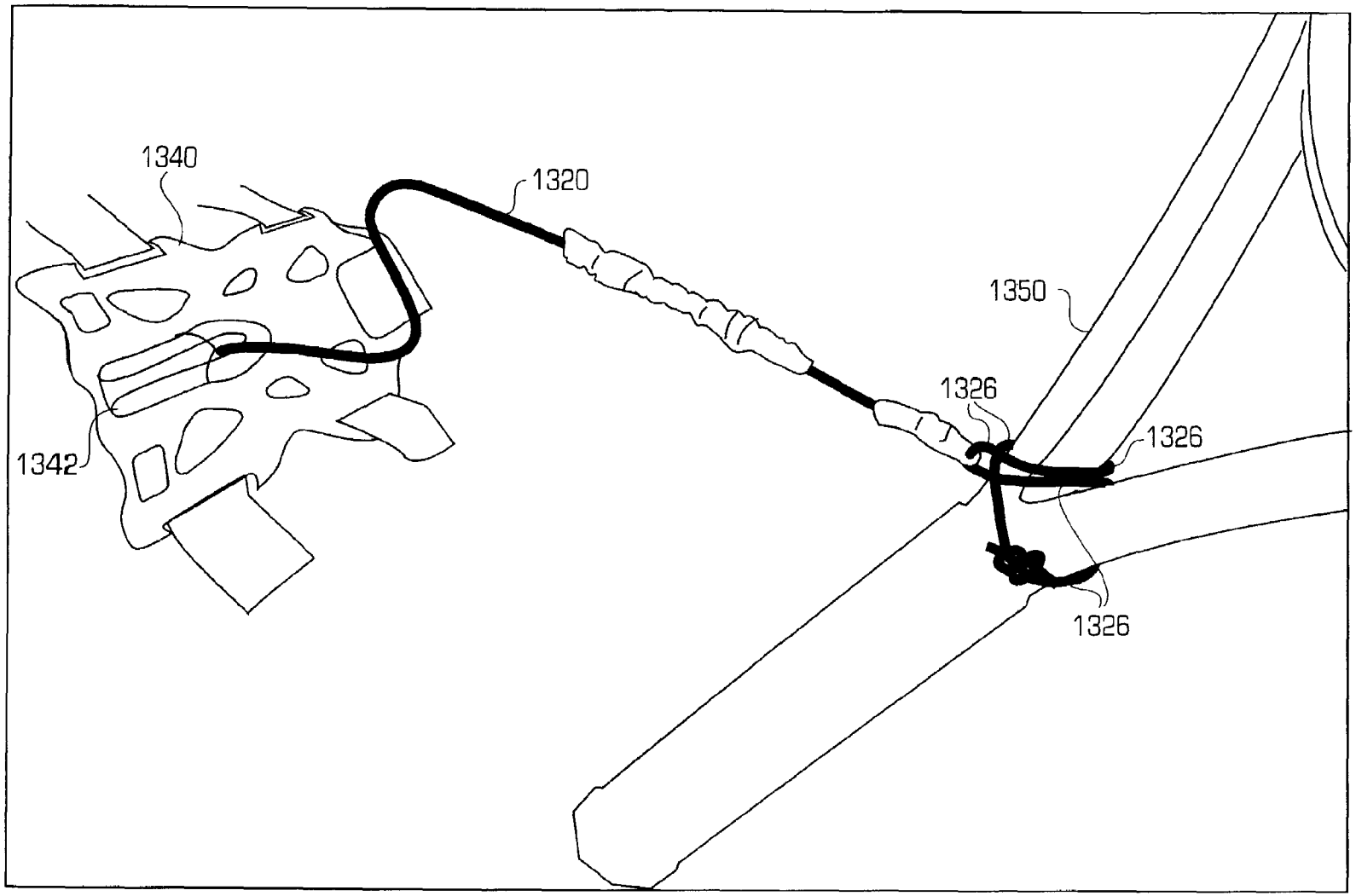
FIG. 13*i* is a view of a fifth step for attaching a tether to the throat of a racket according to a preferred embodiment.

It should be further appreciated that any of the tether embodiments shown in FIGS. 13*b*-13*d* can be attached to racket throat 1350 in various ways. In a preferred embodiment, however, tether 1320 comprises a Y-shaped portion 1326, which attaches to racket throat 1350 according to the steps illustrated in FIGS. 13*e*-13*i*. Within such embodiment, the two ends of Y-shaped portion 1326 are first knotted to form a loop, as shown in FIG. 13*e*. Knotted Y-shaped portion 1326 is then passed through the open portion of the racket, as shown in FIG. 13*f*, and pulled down to the bottom of the racket, as shown in FIG. 13*g*. The loop formed by the knotted Y-shaped portion 1326 is then slipped over the handle of the racket, as shown in FIG. 13*h*, and subsequently tightened onto racket throat 1350 by pulling on tether 1320, as shown in FIG. 13*i*.

Figure 13J:
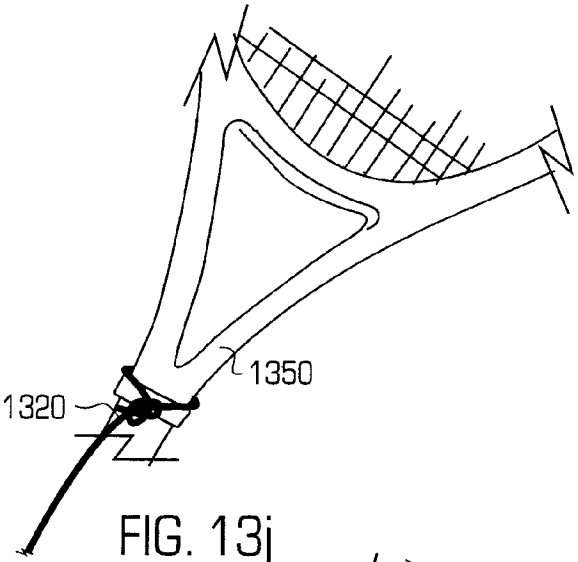
FIG. 13*j* is an illustration of a single-tether embodiment of the present invention, wherein the single-tether is tied to the throat of the racket.
Figure 13K:
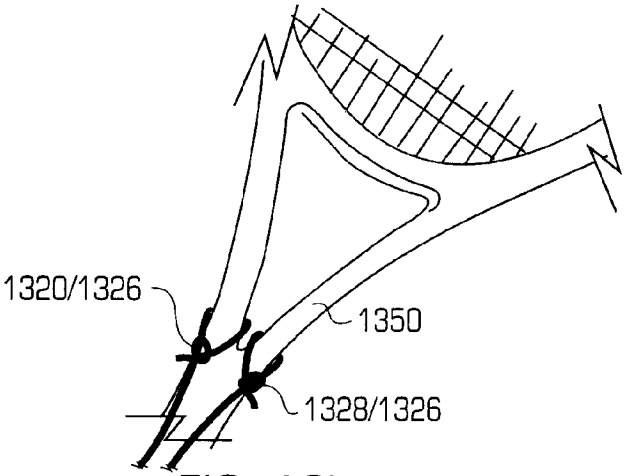
FIG. 13*k* is an illustration of a dual-tether embodiment of the present invention, wherein the dual-tether is tied to the throat of the racket.

Several alternative embodiments for attaching the present invention to racket throat 1350 may also be provided. In FIG. 13*j*, for example, an illustration of a single-tether embodiment is provided, wherein the single-tether 1320 is tied to racket throat 1350, as shown. A similar dual-tether embodiment is provided in FIG. 13*k*, wherein either tethers 1320 and 1328, or Y-tether portion 1326 are tied to racket throat 1350.

Figure 13L:
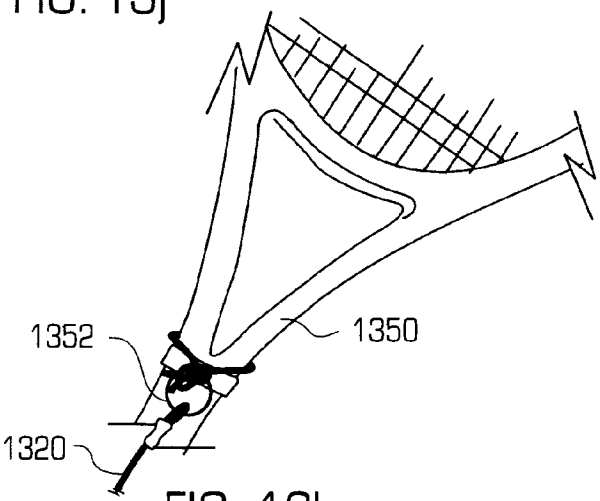
FIG. 13*l* is an illustration of a single-tether embodiment of the present invention, wherein the single-tether is attached to the throat of the racket via an attachment device.
Figure 13M:
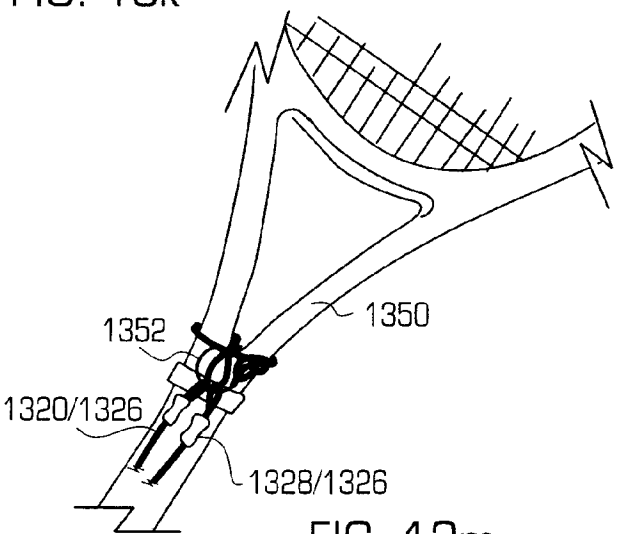
FIG. 13*m* is an illustration of a dual-tether embodiment of the present invention, wherein the dual-tether is attached to the throat of the racket via an attachment device.

The various tether embodiments may also be attached to racket throat 1350 via attachment device 1352, as shown in FIGS. 13*l*-13*m*. In FIG. 13*l*, for example, an illustration of a single-tether embodiment is provided, wherein the single-tether 1320 is attached to racket throat 1350 via a ring-type attachment device 1352. A similar dual-tether embodiment is provided in FIG. 13*m*, wherein either tethers 1320 and 1328, or Y-tether portion 1326 are attached to racket throat 1350 via attachment device 1352, as shown. Here, it should be noted that, although a ring-type attachment device 1352 is shown in FIGS. 13*l*-13*m*, one of ordinary skill in the art would appreciate that similar devices such as a clam-shell, wedge or other device may also be used.

Figure 13N:
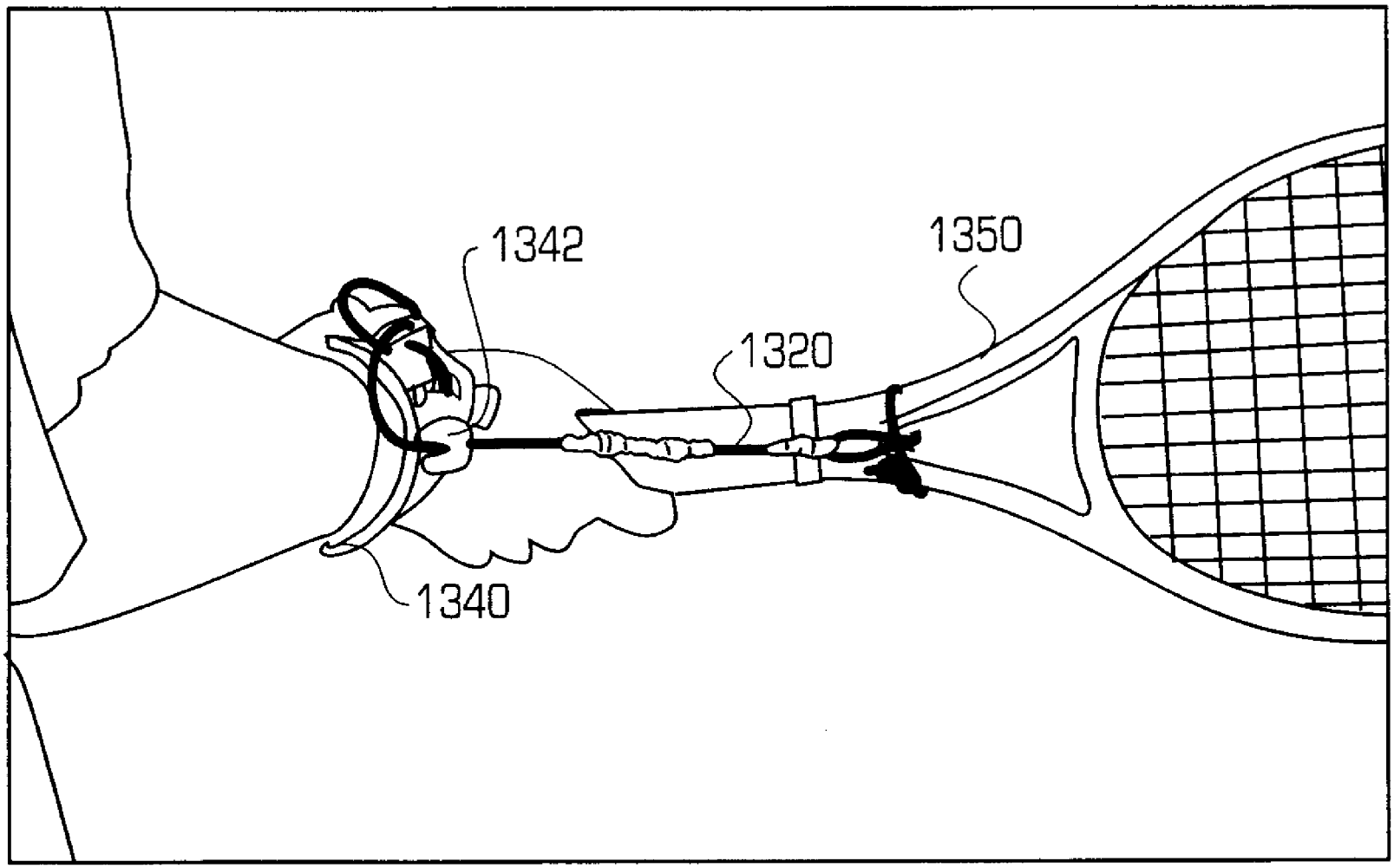
FIG. 13*n* is a view of the alternate embodiment of FIG. 13*a* configured in a usage mode for practicing a one-handed forehand stroke.
Figure 13O:
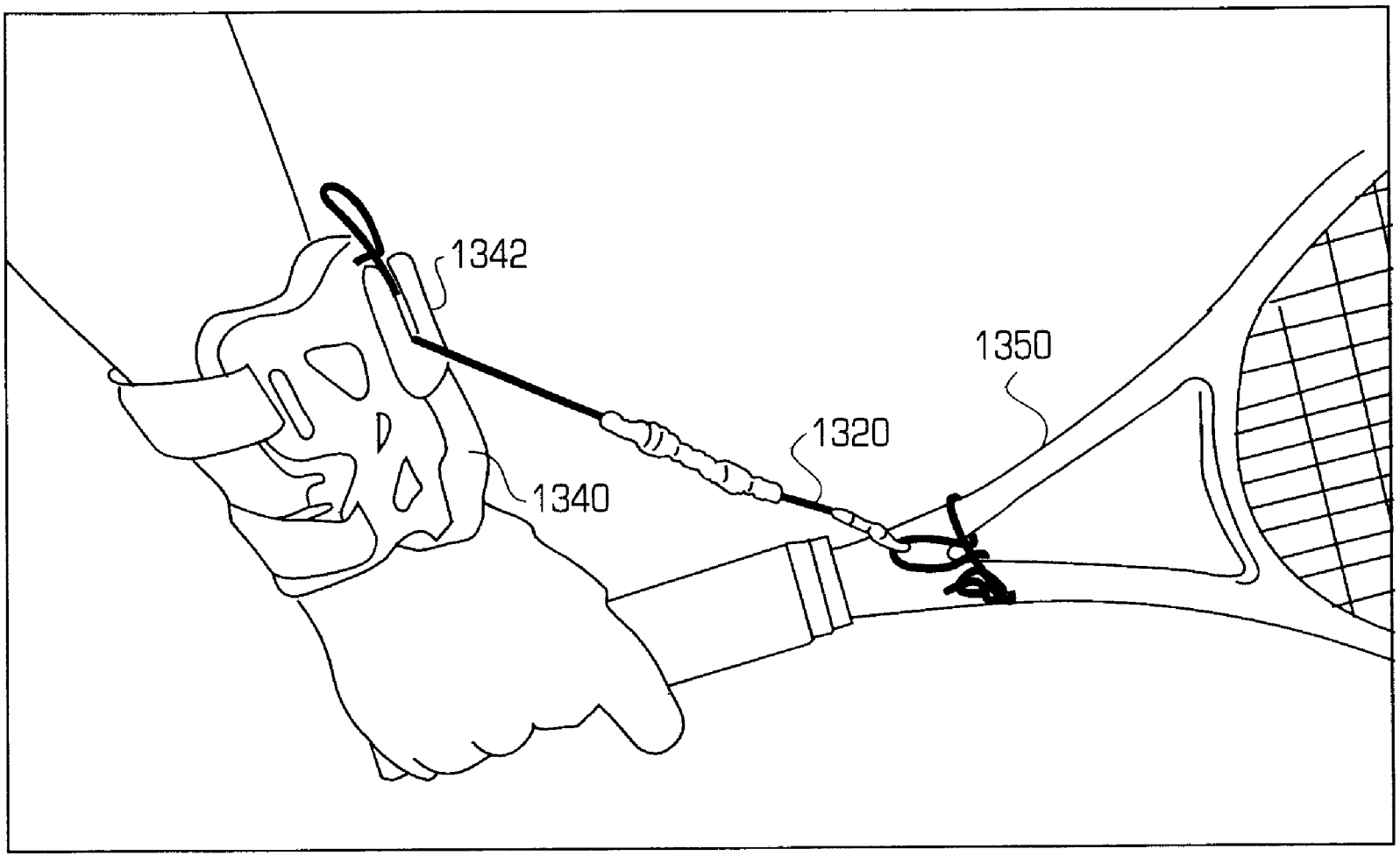
FIG. 13*o* is a view of the alternate embodiment of FIG. 13*a* configured in a usage mode for practicing a one-handed backhand stroke.
Figure 13P:
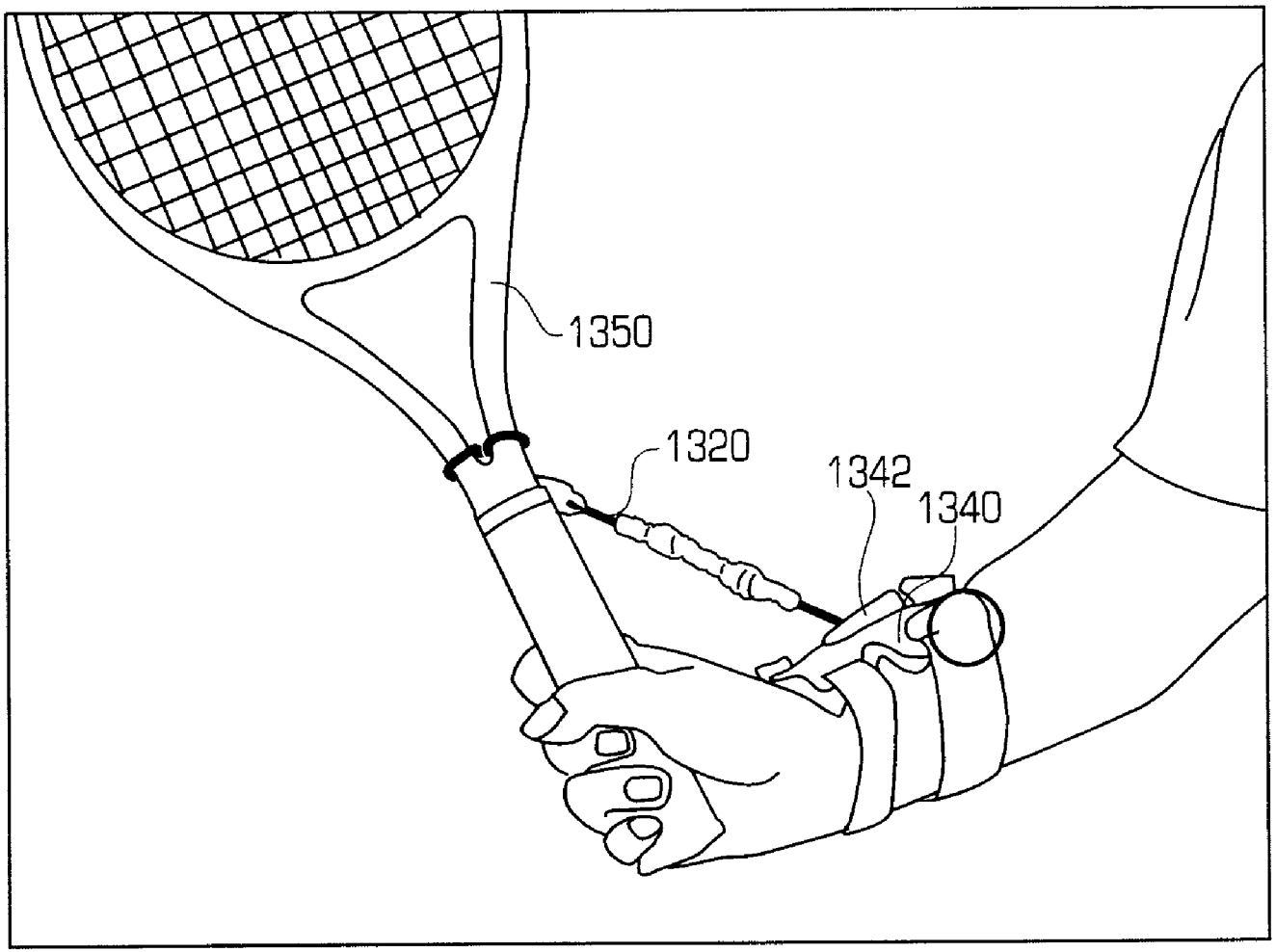
FIG. 13*p* is a view of the alternate embodiment of FIG. 13*a* configured in a usage mode for practicing a forehand volley.
Figure 13Q:
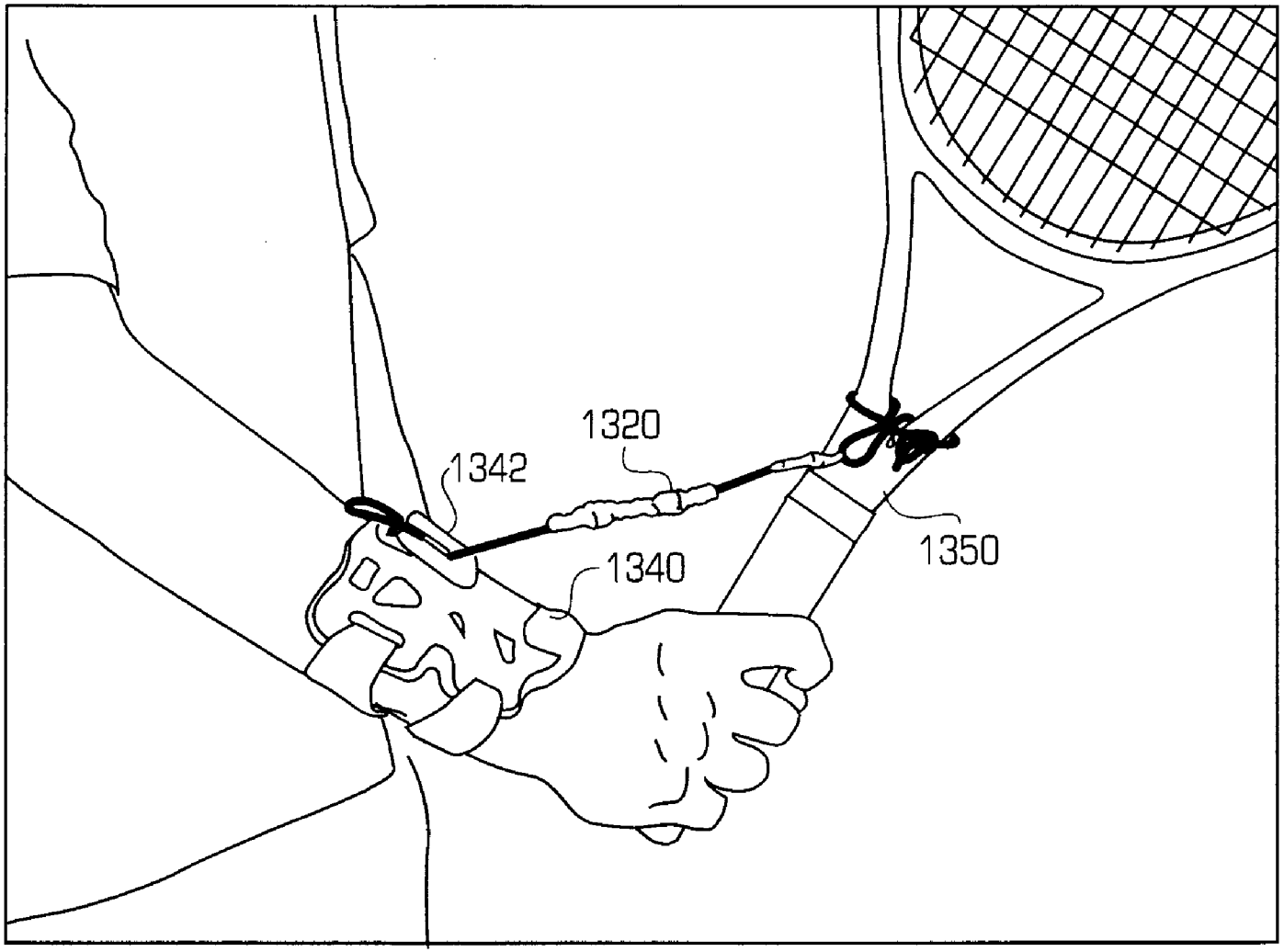
FIG. 13*q* is a view of the alternate embodiment of FIG. 13*a* configured in a usage mode for practicing a backhand volley.
Figure 13R:
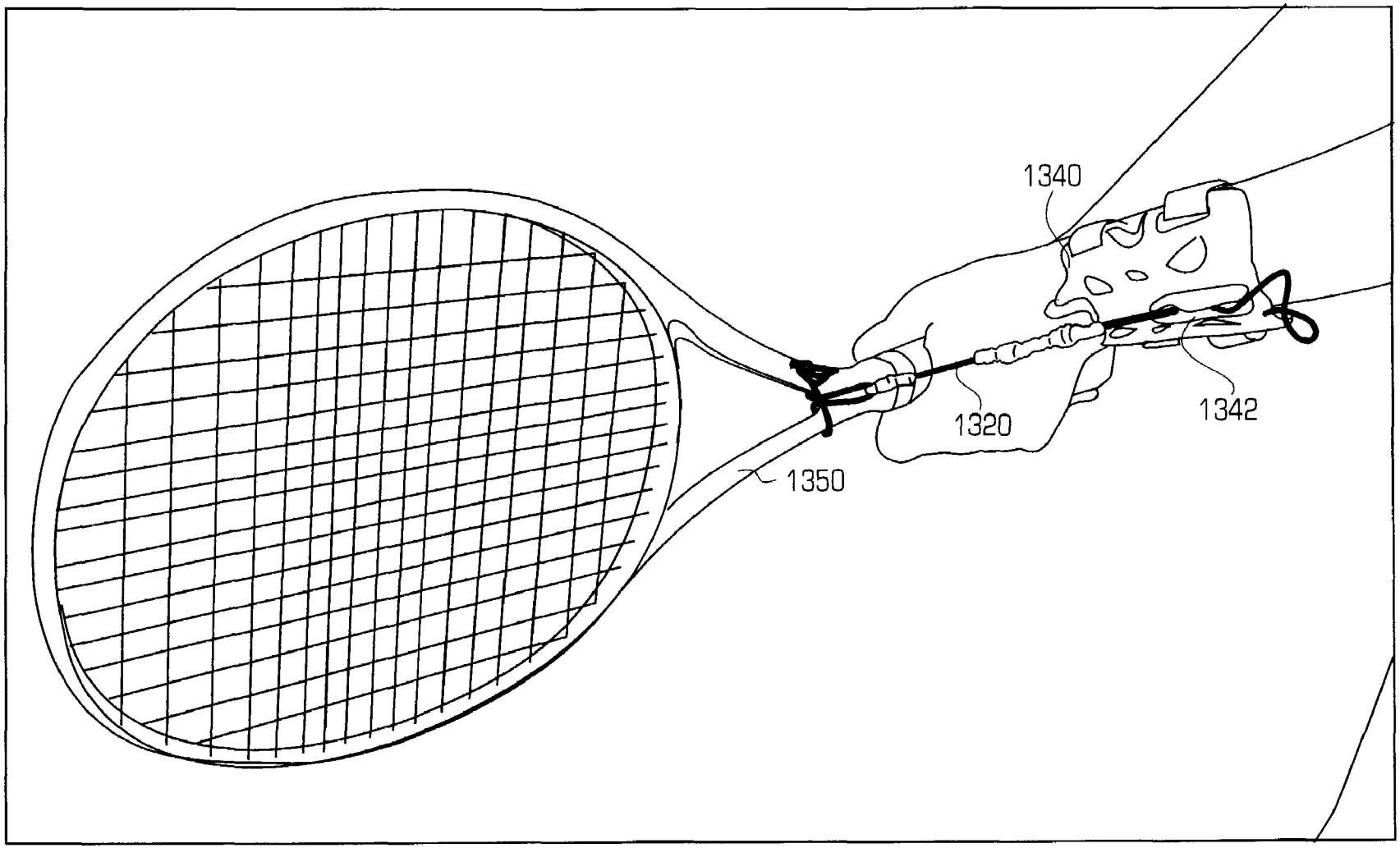
FIG. 13*r* is a view of the alternate embodiment of FIG. 13*a* configured in a usage mode for practicing a two-handed forehand stroke.
Figure 13S:
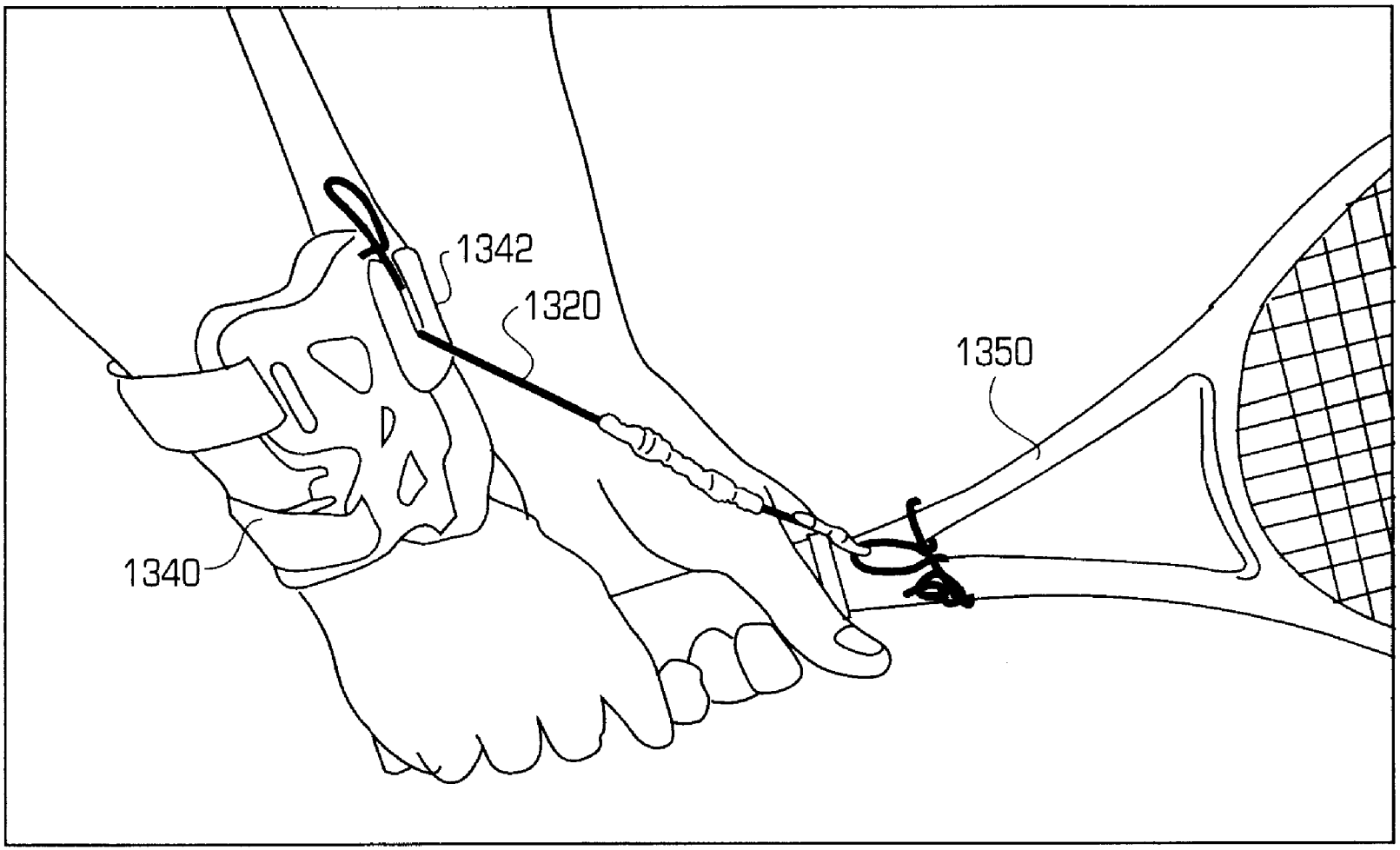
FIG. 13*s* is a view of the alternate embodiment of FIG. 13*a* configured in a usage mode for practicing a two-handed backhand stroke.

By way of example, but not by way of limitation, several schematics illustrating various uses of the embodiment illustrated in FIG. 13*a* are provided herein. FIG. 13*n*, for example, is a view of the embodiment of FIG. 13*a* configured for practicing a one-handed forehand stroke, whereas FIG. 13*o* is a view of the same embodiment configured for practicing a one-handed backhand stroke. Meanwhile, FIGS. 13*p*-13*q* illustrate exemplary embodiments for practicing a forehand volley and backhand volley, respectively. And finally, FIGS. 13*r*-13*s* are provided to show the embodiment of FIG. 13*a* configured for respectively practicing a two-handed forehand stroke and a two-handed backhand stroke.

It should be recognized that a number of variations of the above-identified embodiments will be obvious to one of ordinary skill in the art in view of the foregoing description. Accordingly, the invention is not to be limited by those specific embodiments and methods of the present invention shown and described herein. Rather, the scope of the invention is to be defined by the following claims and their equivalents.

What is claimed is:

1. A tennis training aid, comprising:

a forearm attachment member operable to be releasably attached to a forearm of a player; and a tether attachment having a first and second end, wherein the first end is attached to the forearm attachment member and the second end is attached to a tennis racket throat in order to hold the wrist of the forearm holding that racket at a desired angle so as to allow the player to practice a plurality of different tennis strokes;

wherein the elastic portion comprises a plurality of elastic portions; and wherein at least two of the plurality of elastic portions have different elasticities.

2. A tennis training aid according to claim 1, wherein the at least two elastic portions having different elasticities are in line with each other.

3. A tennis training aid according to claim 1, wherein the at least two elastic portions having different elasticities are separated by a non-elastic portion.

4. A tennis training aid, comprising:

a forearm attachment member operable to be releasably attached to a forearm of a player; and a tether attachment having a first and second end, wherein the first end is attached to the forearm attachment member and the second end is attached to a tennis racket throat in order to hold the wrist of the forearm holding that racket at a desired angle so as to allow the player to practice a plurality of different tennis strokes;

wherein the forearm attachment member further comprises a jam cleat locking mechanism for engaging the tether attachment.

5. A tennis training aid according to claim 4, wherein the tether attachment comprises a Y-tether design.

6. A tennis training aid according to claim 4, wherein the second end of the tether attachment is tied to the tennis racket throat.

7. A tennis training aid according to claim 4, wherein the second end of the tether attachment is attached to the tennis racket throat via an attachment device.

8. A tennis training aid according to claim 4, wherein the forearm attachment member further comprises at least one forearm strap for connecting the forearm attachment member to the forearm of the player.

9. A tennis training aid according to claim 4, wherein the tether attachment comprises a single elastic portion.

10. A tennis training aid according to claim 9, wherein the tether attachment comprises a Y-tether design.

11. A tennis training aid according to claim 9, wherein the second end of the tether attachment is tied to the tennis racket throat.

12. A tennis training aid according to claim 9, wherein the second end of the tether attachment is attached to the tennis racket throat via an attachment device.

13. A tennis training aid according to claim 9, wherein the forearm attachment member further comprises at least one forearm strap for connecting the forearm attachment member to the forearm of the player.

14. A tennis training aid, comprising:

a forearm attachment member operable to be releasably attached to a forearm of a player; and a tether attachment having a first and second end, wherein the first end is attached to the forearm attachment member and the second end is attached to a tennis racket throat in order to hold the wrist of the forearm holding that racket at a desired angle so as to allow the player to practice a plurality of different tennis strokes;

wherein the forearm attachment member further comprises a cam-lock locking mechanism for engaging the tether attachment.

15. A tennis training aid according to claim 14, wherein the tether attachment comprises a Y-tether design.

16. A tennis training aid according to claim 14, wherein the second end of the tether attachment is tied to the tennis racket throat.

17. A tennis training aid according to claim 14, wherein the second end of the tether attachment is attached to the tennis racket throat via an attachment device.

18. A tennis training aid according to claim 14, wherein the forearm attachment member further comprises at least one forearm strap for connecting the forearm attachment member to the forearm of the player.

19. A tennis training aid according to claim 14, wherein the tether attachment comprises a single elastic portion.

20. A tennis training aid according to claim 19, wherein the tether attachment comprises a Y-tether design.

21. A tennis training aid according to claim 19, wherein the second end of the tether attachment is tied to the tennis racket throat.

22. A tennis training aid according to claim 19, wherein the second end of the tether attachment is attached to the tennis racket throat via an attachment device.

23. A tennis training aid according to claim 19, wherein the forearm attachment member further comprises at least one forearm strap for connecting the forearm attachment member to the forearm of the player.

* * * * *